US008547186B2

(12) United States Patent
Kirkeby

(10) Patent No.: US 8,547,186 B2
(45) Date of Patent: Oct. 1, 2013

(54) COMPACT BALUN

(75) Inventor: Niels H. Kirkeby, Jamesville, NY (US)

(73) Assignee: Anaren, Inc., East Syracuse, NY (US)

( * ) Notice: Subject to any disclaimer, the term of this patent is extended or adjusted under 35 U.S.C. 154(b) by 947 days.

(21) Appl. No.: 12/543,295

(22) Filed: Aug. 18, 2009

(65) Prior Publication Data

US 2010/0026412 A1 Feb. 4, 2010

Related U.S. Application Data

(63) Continuation-in-part of application No. 11/419,091, filed on May 18, 2006, now Pat. No. 7,646,261.

(60) Provisional application No. 61/089,637, filed on Aug. 18, 2008, provisional application No. 60/715,696, filed on Sep. 9, 2005.

(51) Int. Cl.
*H01P 5/10* (2006.01)

(52) U.S. Cl.
USPC ..... 333/26; 333/125

(58) Field of Classification Search
USPC ..... 333/112, 118, 25, 26, 33, 35, 128, 333/204, 125
See application file for complete search history.

(56) References Cited

U.S. PATENT DOCUMENTS 6,351,192 B1 * 2/2002 Sheen ..... 333/26
2005/0099241 A1 * 5/2005 Ezzeddine ..... 333/25

OTHER PUBLICATIONS

Fathelbab et al.; New Classes of Miniaturized Planar Marchand Baluns; IEEE Transactions on Microwave Theory and Techniques, vol. 53, No. 4, Apr. 2005.

* cited by examiner

*Primary Examiner* — Benny Lee
*Assistant Examiner* — Gerald Stevens
(74) *Attorney, Agent, or Firm* — Daniel P. Malley; Bond Schoeneck & King

(57) ABSTRACT

The present invention is directed to a compact balun device that includes an unbalanced port and a set of balanced differential ports. A first set of coupled transmission line structures is coupled to the unbalanced port and one port of the set of balanced differential ports. The first set of coupled transmission line structures is characterized by at least one device parameter and a first length that is substantially equal to a quarter of a wavelength (λ). The wavelength (λ) corresponds to a first frequency. A second set of coupled transmission line structures is coupled to another port of the set of balanced differential ports. The second set of coupled transmission line structures is characterized by the at least one device parameter and a second length that is substantially equal to the quarter of a wavelength (λ). The wavelength (λ) corresponds to the first frequency. A plurality of interconnections couples the first set of coupled transmission line structures and the second set of coupled transmission line structures. The plurality of interconnections are configured such that the compact balun operates at a reduced operating frequency, the reduced operating frequency being selected from a range of frequencies by varying at least one device parameter. The range of frequencies is approximately between one-sixth of the first frequency and one-half the first frequency.

34 Claims, 17 Drawing Sheets

COMPACT BALUN

CROSS-REFERENCE TO RELATED APPLICATIONS

This Patent Application claims priority under 35 U.S.C. §119(e) to U.S. Provisional Patent Application Ser. No. 61/089,637 filed on Aug. 18, 2008, the content of which is relied upon and incorporated herein by reference in its entirety. This patent application is also a continuation-in-part of U.S. patent application Ser. No. 11/419,091 under 35 U.S.C. §120, filed May 18, 2006, the content of which is relied upon and incorporated herein by reference in its entirety. U.S. patent application Ser. No. 11/419,091 claims priority under 35 U.S.C. §119(e) to U.S. Provisional Patent Application Ser. No. 60/715,696, filed on May 9, 2005.

BACKGROUND OF THE INVENTION

1. Field of the Invention

The present invention relates generally to RF and microwave components, and particularly to balun devices.

2. Technical Background

A balun is a device that is employed in various types of applications to convert differential (balanced) signals to unbalanced signals, and vice-versa. A Balun may also function as a transformer and is often used as a means to change or match impedances within a portion of an RF network. Balanced signals require two transmission paths. One path carries a first signal and the second path carries a second signal that is of equal amplitude and opposite in phase to the first signal. This arrangement is typically employed to cancel the deleterious effects of noise and interference that might otherwise degrade a single-ended signal. On the other hand, there are certain components in RF and wireless devices, such as power amplifiers and antennas, that are typically implemented as single ended signal devices. Accordingly, a balun is required when a device includes single-ended and differential components in a signal path.

A very popular balun for use at RF and microwave frequencies is the Marchand balun. The Marchand balun typically includes two $\lambda/4$ coupled sections that are configured to provide balanced performance. In a symmetric TEM structure, the odd-mode and the even-mode impedances of the coupled structure define the transformation ratio from the single ended impedance to the differential impedance of the balun.

In one approach that has been considered, each of the $\lambda/4$ transmission line structures is disposed in a spiraled geometry to minimize the size of the balun in the X-Y plane and make the Marchand balun more compact. The size in the X-Y plane is further reduced, albeit at the expense of the z-dimension (i.e., profile height), by placing the coupled transmission line sections one atop the other. The typical market for such components will accommodate profile heights up to 1 mm for direct assembly onto circuit board and 0.4-0.6 mm for integration into RF modules. This approach, however, has drawbacks and limitations. In order to realize further size reductions, the dielectric constant of the dielectric material employed in the sandwiched structure must be increased to lower the quarter wavelength frequency. Unfortunately, this makes manufacturing tolerances more pronounced. The resultant balun usually exhibits a degraded performance because it is difficult to maintain an adequately high even-mode impedance and low DC resistance when the dielectric constant is high. Alternatively, if a lower dielectric constant is used, the conductor trace widths are smaller and the metal trace lengths longer. This approach, however, is unattractive because it increases insertion loss and DC resistance What is needed therefore, is a compact balun that overcomes the deficiencies described above. In particular, what is needed is a compact balun that operates at a reduced commensurate frequency that is a fraction of the normal operating frequency of a Marchand balun of substantially the same or similar size. It is also desirable that the compact Marchand balun can be implemented with an arbitrarily selected transformation ratio.

SUMMARY OF THE INVENTION

The present invention addresses the needs described above by providing a compact Marchand balun that operates at a reduced commensurate frequency that may be selected from a range of frequencies that is substantially between one-sixth and one-half of the normal operating frequency of a Marchand balun of substantially the same or similar size. The compact Marchand balun of the present invention may be made with substantially any arbitrary transformation ratio.

One aspect of the present invention is directed to a compact balun device that includes an unbalanced port and a set of balanced differential ports. A first set of coupled transmission line structures is coupled to the unbalanced port and one port of the set of balanced differential ports. The first set of coupled transmission line structures is characterized by at least one device parameter and a first length that is substantially equal to a quarter of a wavelength ($\lambda$). The wavelength ($\lambda$) corresponds to a first frequency. A second set of coupled transmission line structures is coupled to another port of the set of balanced differential ports. The second set of coupled transmission line structures is characterized by the at least one device parameter and a second length that is substantially equal to the quarter of a wavelength ($\lambda$). The wavelength ($\lambda$) corresponds to the first frequency. A plurality of interconnections couples the first set of coupled transmission line structures and the second set of coupled transmission line structures. The plurality of interconnections are configured such that the compact balun operates at a reduced operating frequency, the reduced operating frequency being selected from a range of frequencies by varying at least one device parameter. The range of frequencies is approximately between one-sixth of the first frequency and one-half the first frequency.

Another aspect of the present invention is directed to a compact balun device that includes a first pair of coupled transmission lines connected to a second pair of coupled transmission lines, an unbalanced port, and a set of balanced differential ports. Each transmission line is characterized by a length that is substantially equal to a quarter of a wavelength ($\lambda$), the wavelength ($\lambda$) corresponding to a first frequency. A third transmission line is coupled to the first pair to thereby form a first set of coupled transmission lines. A fourth transmission line is coupled to the second pair to thereby form a second set of coupled transmission lines. The first set of coupled transmission lines is connected to the second set of coupled transmission lines such that the compact balun operates at a reduced operating frequency. The reduced operating frequency is selected from a range of frequencies by varying at least one device parameter. The range of frequencies is approximately between one-sixth of the first frequency and one-half the first frequency.

Yet another aspect of the present invention is directed to a compact balun device includes a Marchand balun structure having a first pair of coupled transmission lines connected to a second pair of coupled transmission lines, an unbalanced port, and a set of balanced differential ports. Each transmission line is characterized by a length that is substantially equal to a quarter of a wavelength (λ), the wavelength (λ) corresponding to a first frequency. A third transmission line is coupled to the first pair of coupled transmission lines to thereby form a first set of coupled transmission lines and a fourth transmission line coupled to the second pair of coupled transmission lines to thereby form a second set of coupled transmission lines. The first set of coupled transmission lines is connected to the second set of coupled transmission lines such that the compact balun operates at a reduced operating frequency. The reduced operating frequency is selected from a range of frequencies by varying at least one device parameter. The range of frequencies is approximately between one-quarter of the first frequency and one-half the first frequency.

Accordingly, the compact balun of the present invention effectively lowers the operational frequency by a factor of approximately two or four (relative to a conventional Marchand balun of substantially the same or similar size). Hence less line length is needed and the balun can be kept compact without the use of high dielectric constant material.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1:
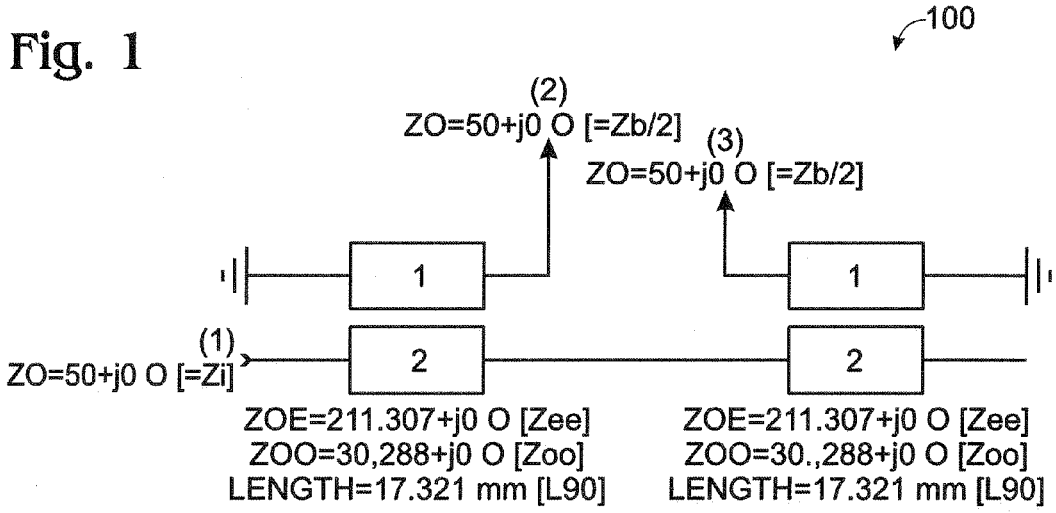
FIG. 1 is a schematic of an ideal Marchand balun.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the device of the present invention is shown in FIGS. 8-25, and is designated generally throughout by reference numeral 10.

The present invention is directed to a compact balun that effectively lowers the operational frequency of the balun by a factor between approximately 1.5 to 6, and by potentially as much as 25, with the addition of discrete capacitance. Hence, less line length is needed and the compact nature of the balun is maintained without the use of exotic dielectric materials. The present invention applies to single-ended to balanced impedance transformations, single-ended to single-ended impedance transformations, and balanced to balanced impedance transformations. The present invention is particularly applicable when size and cost are issues in a balun required for impedance transformation and/or single-ended signal to balanced signal transformations. The present invention is also applicable when common mode rejection is an important design issue. The present invention may be implemented using a variety of techniques including broadside and edge coupled implementations.

Referring to FIG. 1, a schematic of an ideal Marchand balun 100 is shown. As noted previously, the present invention is inspired by the Marchand balun and is, therefore, the starting point in the theoretical development of the invention. One design equation for the conventional Marchand balun shown in FIG. 1 may be expressed as:

$$Z_{oo} = \frac{-Z_0^2 + Z_0\sqrt{Z_0^2 + Z_i Z_b}}{\sqrt{Z_i Z_b}} \text{ and } Z_{ee} = \frac{Z_0^2}{Z_{oo}}$$

The system impedance $Z_0$ for coupled structures may be chosen somewhat arbitrarily for narrowband performance, but has an optimal value for the most wideband applications. For example, Marchand baluns may be designed successfully with the following criteria:

$$Z_{ee} \stackrel{\rho}{=} \infty \text{ and } Z_{oo} = \frac{Z_b}{2},$$

As long as $Z_{ee} >> Z_{oo}$ then $Z_{ee}$ can be chosen arbitrary to have more manageable values (e.g., from approximately 200 Ω to about 1000 Ω). As noted above, a high dielectric constant material reduces the even-mode impedance that is practically attainable and is, therefore, not desirable. The aim of the design method of the present invention is not to produce the maximum bandwidth for a given return loss specification, but rather it provides an efficient method for designing very wide band parts in a minimum x-y area.

Figure 2:
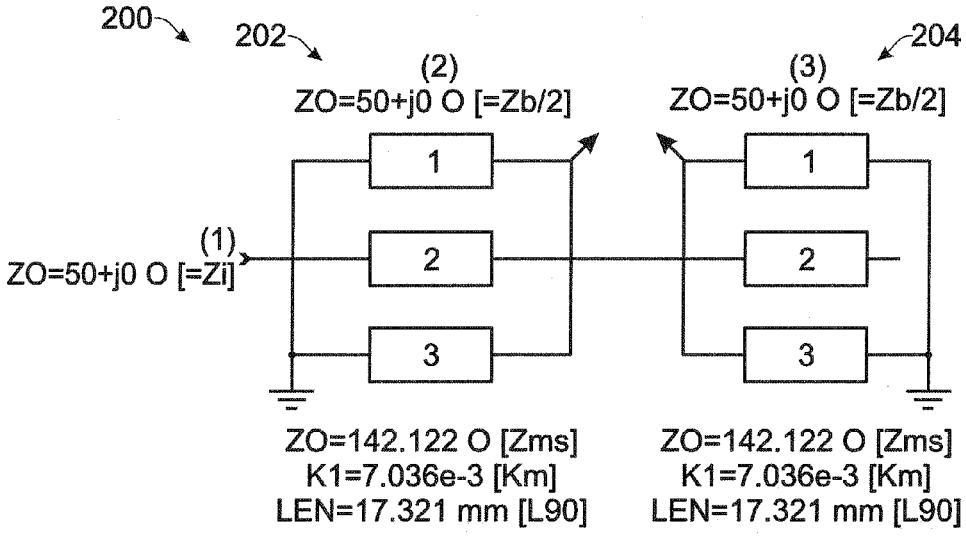
Related Art Fig. 2
FIG. 2 is a schematic of an interdigital Marchand balun.

Referring to FIG. 2, an interdigital Marchand balun 200 is shown that may be implemented both in a broad-side implementation and edge coupled implementation. This device is referred to as an interdigital Marchand device because it employs two vertical interdigital couplers, 202 and 204. The single, unbalanced end is connected to transmission line 2 of coupler 202, which is connected to the second (2) transmission line of coupler 204. One end of the first (1) and third (3) transmission lines of both couplers (202, 204) are grounded; the other ends are connected together and form the balanced ports. Reference is made to U.S. patent application Ser. No. 11/419,091, filed on May 18, 2006, which is incorporated herein by reference as though fully set forth in its entirety, for a more detailed explanation of a vertical interdigital coupler. The inventor of the vertical interdigital coupler and the present invention are one and the same.

The broad-side implementation cuts in half the required coupled line width relative to conventional designs to achieve the same odd mode impedance, which significantly reduces the required X and Y dimensions required in meandered or spiraled implementations. At the same time, the even mode impedance is increased because of the narrower transmission lines. This method of reducing balun size is efficient when the odd mode impedance must be relatively low and when a high degree of coupling is desired (i.e., high even/odd mode ratio).

Figure 3:
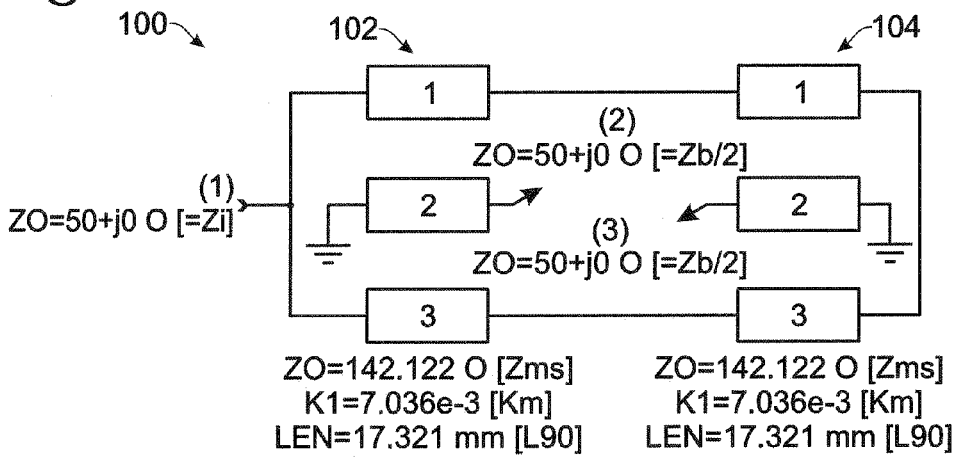
FIG. 3 is a schematic of an alternative interdigital Marchand balun.

FIG. 3 is a schematic view of an alternative interdigital Marchand balun 300. One end of the second transmission line of both couplers (302, 304) is grounded whereas the other ends form the differential ports. The unbalanced port is connected to the first (1) and third (3) transmission lines of coupler 302. The other ends of the first (1) and third (3) transmission lines of coupler 302 are connected to the first (1) and third (3) transmission lines of coupler 304. The first (1) and third (3) transmission lines of coupler 304 are connected together. Other variations are also possible, e.g., not connecting transmission line 1 & 3 on the right side, or criss-crossing the signals in the middle. There are many other design methods/relations that may be used depending on the desired balun performance.

Another issue facing designers relates to the interplay of size and frequency. One goal is to implement a Marchand balun structure that maintains the size reductions obtained by the approaches employed above while, at the same time, driving the center frequency downward to, for example, one-half or one-quarter of the frequency of the conventional device.

Referring back to the conventional and idealized Marchand structure depicted in FIG. 1, the following relationships may be defined:

$$k = \frac{Z_e - Z_o}{Z_e + Z_o},\ Z_s = \sqrt{Z_e Z_o},$$

$$Z_1 = \frac{Z_s}{\sqrt{1-k^2}},$$

$$Z_2 = \frac{Z_s\sqrt{1-k^2}}{k^2} \text{ and } N = \sqrt{1 + \frac{Z_2}{Z_1}} = \frac{1}{k}$$

Figure 4:
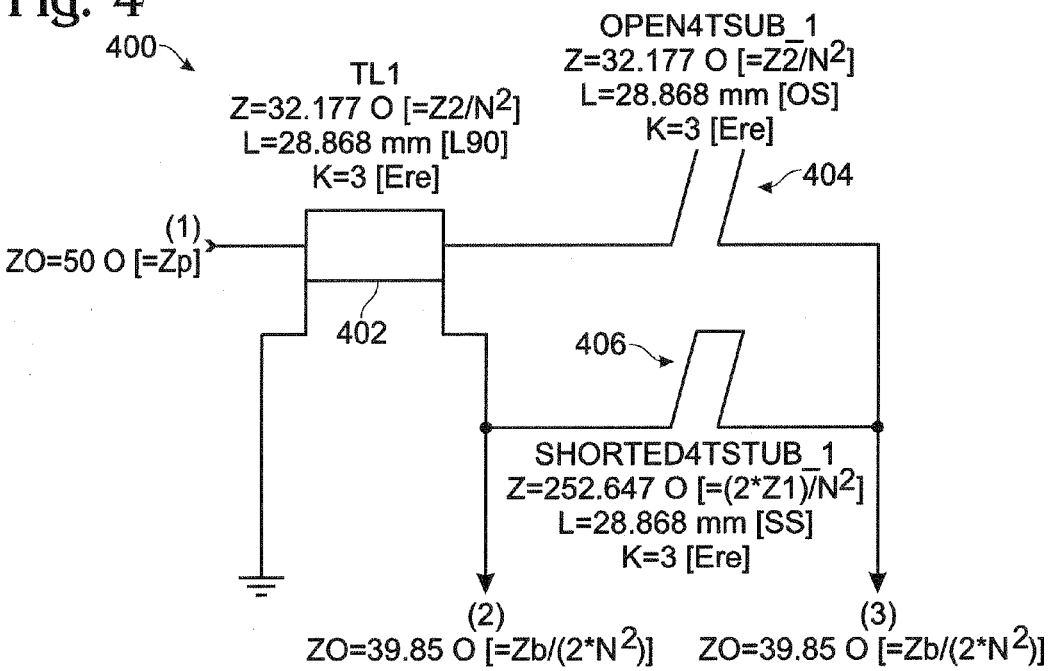
FIG. 4 is an S-plane Marchand equivalent circuit.

Referring to FIG. 4, an S-plane Marchand equivalent 400 may be obtained from the expression provided immediately above. S-plane Marchand equivalent 400 includes an unbalanced port connected to transmission line 402. The opposite side of the transmission line 402 includes a parallel structure disposed between the balanced ports. The parallel circuit includes an open stub 404 in parallel with a shorted stub 406. The equivalent circuit may be seen as a high pass structure in the S-plane having two poles: one pole is at Zero, and the other one is at Infinity. Accordingly, an S-plane band pass structure may be employed to provide a reduced size Marchand balun that operates at a center frequency that is less than the quarter wavelength frequency of a Marchand coupler of similar size.

Figure 5:
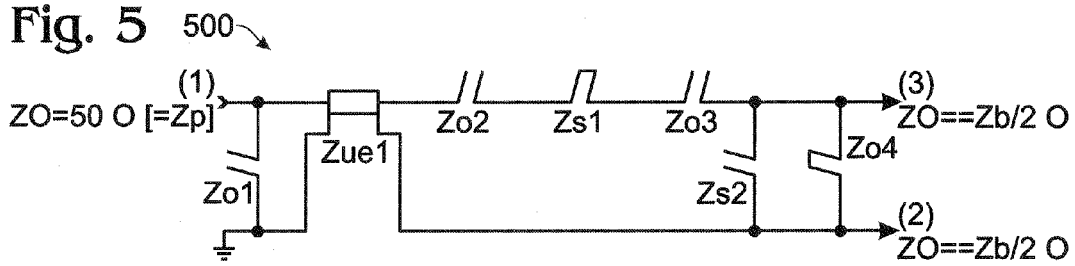
FIG. 5 is an S-plane Marchand equivalent circuit of a prototype design.
Figure 6A:
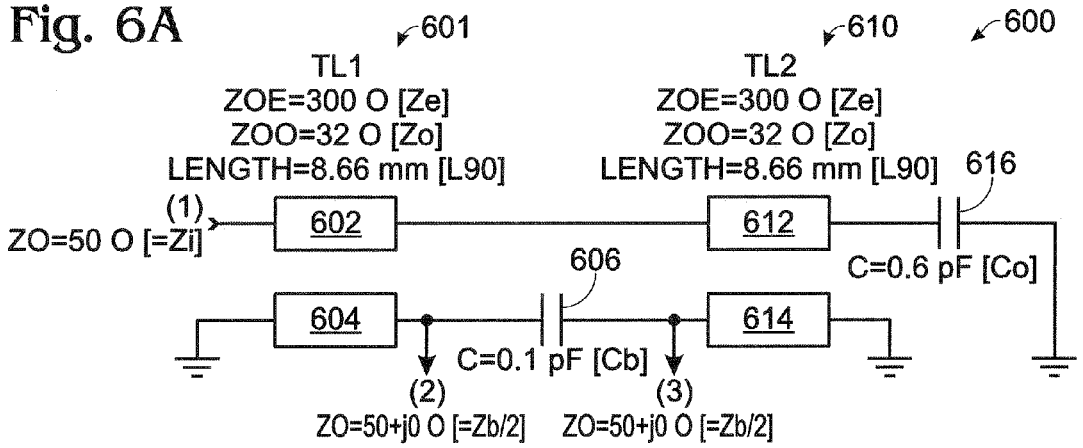
FIGS. 6A is a schematic of a physical implementation of the S-plane equivalent circuit depicted in FIG. 5.
Figure 6B:
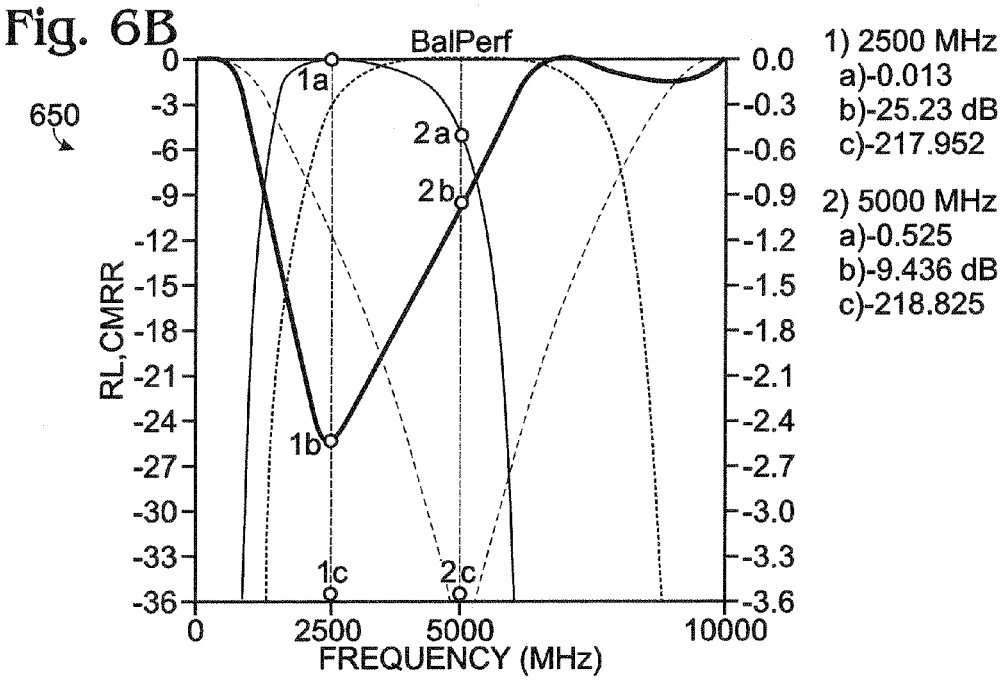
FIG. 6B is a graphical plot illustrating the performance of the device of FIG. 6A.
Figure 7A:
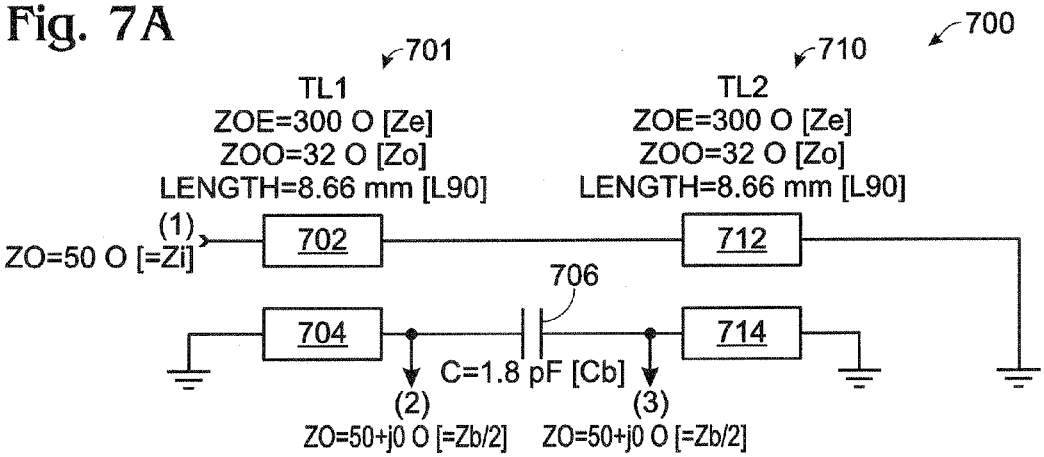
FIG. 7A is a specialized version of the device depicted in FIG. 6A.
Figure 7B:
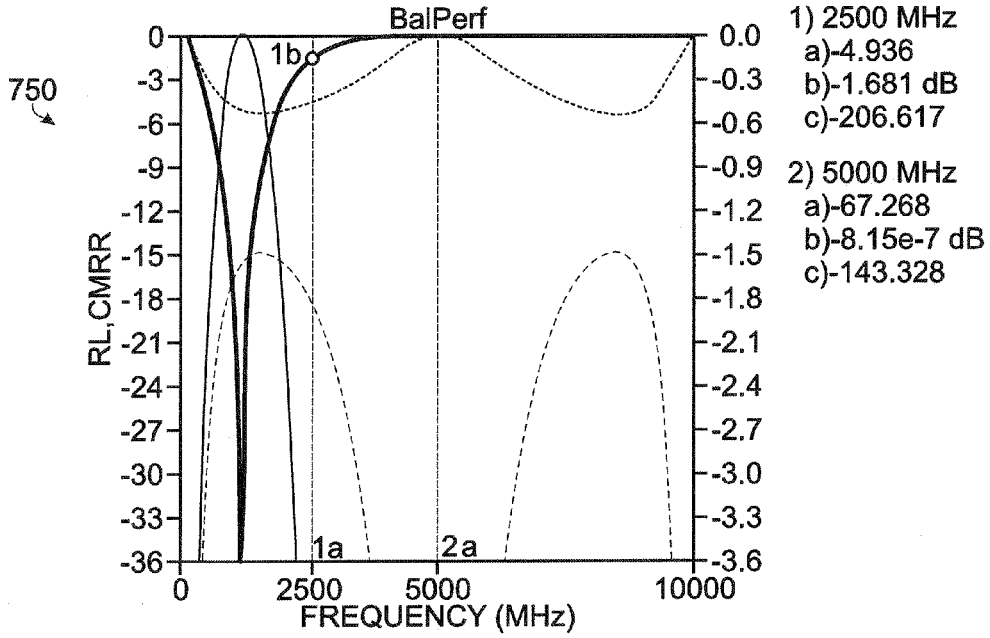
FIG. 7B is a graphical plot illustrating the performance of the device of FIG. 7A.

In particular, the S-plane bandpass prototype design depicted in FIG. 5 is transformed into the physical implementations depicted in FIGS. 6 and 7 in accordance with the present invention. FIGS. 6A and 7A represent two physical implementations of the S-plane bandpass equivalent depicted in FIG. 5 that are of particular interest to the present inventor. A sample performance of each of these implementations is shown in FIGS. 6B and 7B respectively, but those skilled in the art will understand that many other performances are attainable. The balun of FIG. 7A, for all frequencies greater than zero, is recognized as being the special case of the balun shown in FIG. 6A where $C_o = \infty$.

Referring to FIG. 6A, balun 600 includes a first coupler 601 having coupled transmission lines 602 and 604. The unbalanced port is connected transmission line 602 whereas one end of transmission line 604 is grounded. The internal end of transmission line 602 is connected to transmission line 612 of coupler 610. The internal end of transmission line 604 is connected to one of the balanced ports and the internal end of transmission line 614 is connected to the balanced port. The balanced ports include a capacitor Cb disposed therebetween. Further transmission line 612 is coupled to ground via a second capacitor Co. Thus, the implementation of FIG. 6A requires adjustment capacitors $C_o$ and $C_b$.

Referring to FIG. 6B, note that as $C_o$ increases, the frequency curve shifts downward to provide the desired effect. However for a real load, when $C_o$ is increased the insertion loss performance is degraded by a mismatch as the balun becomes increasingly inductive. In order to compensate for the insertion loss degradation, a second capacitor $C_b$ is disposed between the balanced outputs. Similar effects may be achieved using transmission line stubs. While this approach provides the desired downward frequency shift, it has drawbacks that are immediately apparent.

FIG. 7A is seen as a special case of the balun depicted in FIG. 6A. Note that capacitor Co is eliminated from the design, but the value of capacitor Cb is increased from 0.1 pF to 1.8 pF. The performance of this implementation is depicted in FIG. 7B.

While a lower commensurate frequency is achieved by adding additional open stubs or capacitors, or a combination of the two, the additional components translate to an increase in the amount of "real-estate" required by the design. The capacitors may be implemented as discrete/lumped parts. However, they represent additional components. Accordingly, the overall RF design would require layout modifications to accommodate the balun. In other words, if the balun were to be used in the design, the end-customer would have to incur the cost of procuring the additional capacitors, providing a larger circuit board to accommodate the parts, and assembling a circuit board that includes more components. Obviously, this is a drawback and the customer would probably seek a smaller and/or less costly alternative.

Alternatively, the capacitors could be implemented as lumped components in the dielectric material of the balun. However using common materials, this approach also occupies a significant amount of real-estate, which for a fixed device size would occupy area that could otherwise be used for the coupled transmission lines of the generic Marchand. A reduction in size may be achieved if more exotic materials are employed, but the tradeoff can be undesirable. The use of exotic materials pose potential material compatibility issues and require special processing techniques. There are also, from a performance standpoint, tolerance concerns. Thus, the use of specialty materials is very likely to be more expensive than using discrete capacitors. One may consider using semiconductor processes to overcome these issues because such techniques offer high density capacitors with good accuracy/tolerance. On the other hand, these processes make it difficult to achieve the tight coupling often needed to get the desired transformation ratio at the system impedance.

Referring back to FIG. 6A, lowering the commensurate frequency below the quarter wavelength frequency is very desirable, but the method for lowering the frequency is not suitable because the size of added components is prohibitive. For example, a properly designed capacitor $C_o$, i.e., one that has a properly selected capacitance value, would be of approximately the same size as the balun itself. Further, capacitor $C_b$ would be of similar dimensions. For instance a 0201 sized capacitor with the necessary soldering pads and keepouts will occupy approximately half the area of a 1 mm square balun. The balun size would therefore need to drop 50% for the solution to occupy the same area. This solution may not be feasible due to the vias and keepouts within the balun implementation that require a minimum amount of space regardless of shorter transmission line lengths inside. Further, if exotic materials are used to shrink the capacitor sizes, then tolerance issues relative to capacitor $C_o$ are unacceptable because small process variations can result is comparatively large changes in the center frequency. Both of these drawbacks translate to manufacturing and performance related issues that may be difficult to overcome considering the fact that the customer buying the balun is seeking an off-the-shelf balun and not a customized design.

Figure 8:
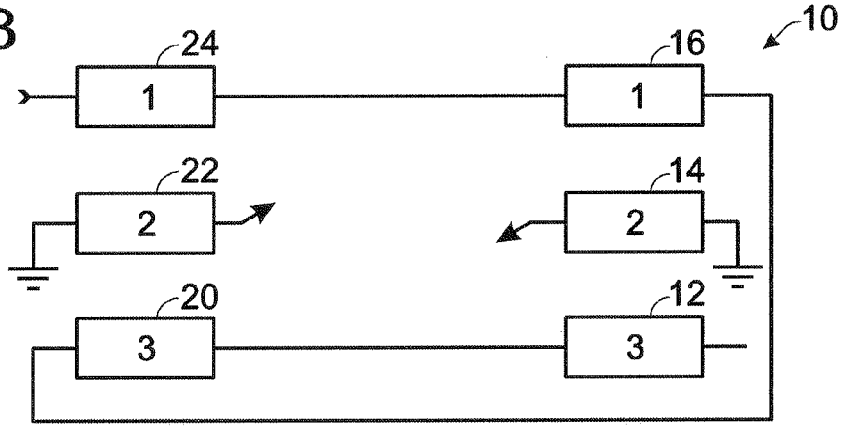
FIG. 8 is a schematic view of a balun in accordance with an embodiment of the present invention.

As embodied herein and depicted in FIG. 8, a schematic of a balun 10 in accordance with one embodiment of the present invention is disclosed. Marchand balun 10 includes a λ/4 transmission line 24 coupled between unbalanced port 1 and λ/4 transmission line 16. In the conventional Marchand balun depicted in FIG. 1, transmission line 16 is typically open-circuited. However, in accordance with the teachings of the present invention, transmission line 16 is coupled to transmission line 20, which is further coupled to transmission line 12. λ/4 transmission line 22 is disposed in an inter-digital manner between transmission line 24 and transmission line 20. Transmission line 22 is grounded on one end and provides balanced port 1 at the opposite end. In similar fashion, λ/4 transmission line 14 is disposed between transmission line 16 and transmission line 12. Transmission line 14 is grounded on one end and provides balanced port 2 at the opposite end. The present invention achieves a commensurate frequency lowering by employing an additional coupled transmission line within the context of a Marchand balun structure. In this embodiment, the compact Marchand balun operates at a reduced nominal commensurate frequency that is nominally one half of the normal operating frequency of a Marchand balun of substantially the same or similar size. In practice, the nominal commensurate frequency may be selected from a frequency that is within a range of frequencies by varying certain physical parameters as explained below. The range of frequencies is substantially between one-sixth to two-thirds of the normal operating frequency. Accordingly, balun 10 of the present invention may be made with substantially any arbitrary transformation ratio.

Figure 9:
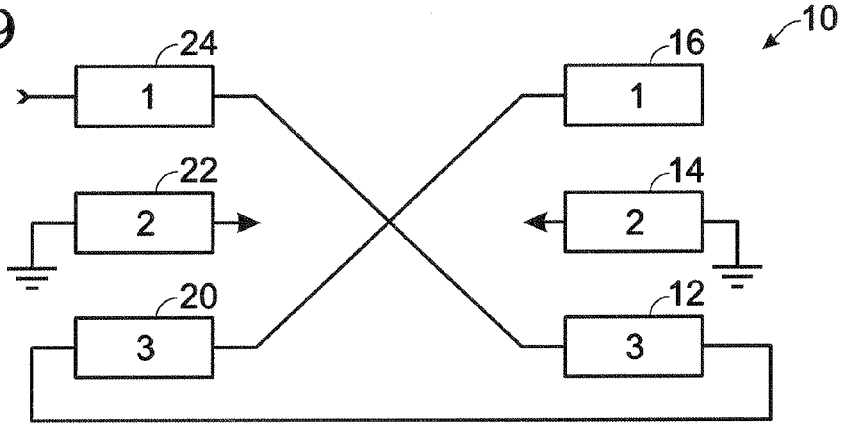
FIG. 9 is a schematic view of a balun in accordance with an alternate embodiment of the present invention.

Referring to FIG. 9, a schematic of a balun in accordance with an alternate embodiment of the present invention is disclosed. This embodiment is similar to the balun depicted in FIG. 8, but includes several notable differences. This embodiment features a cross-connection between λ/4 transmission line 24 and λ/4 transmission line 12. The other end of λ/4 transmission line 12 is connected to λ/4 transmission line 20. Transmission line 20 is cross-connected to λ/4 transmission line 16. In this embodiment, the compact Marchand balun operates at a reduced nominal commensurate frequency that is nominally one half of the normal operating frequency of a Marchand balun of substantially the same or similar size. In practice, the nominal commensurate frequency may be selected from a frequency that is within a range of frequencies by varying certain physical parameters as explained below. The range of frequencies is substantially between one-six to two-thirds of the normal operating frequency.

Figure 10:
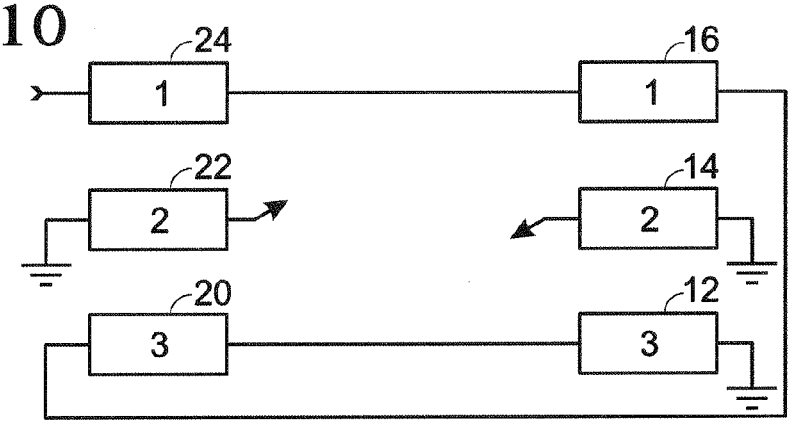
FIG. 10 is a schematic view of a balun in accordance with yet another alternate embodiment of the present invention.

Referring to FIG. 10, a schematic of a balun in accordance with an alternate embodiment of the present invention is disclosed. This embodiment is structurally identical to the balun depicted in FIG. 8. The difference between this embodiment and the one depicted in FIG. 8 is that transmission line 12 is grounded instead of being open-circuited. In this embodiment, the compact Marchand balun operates at a reduced nominal commensurate frequency that is nominally one quarter of the normal operating frequency of a Marchand balun of substantially the same or similar size. In practice, the nominal commensurate frequency may be selected from a frequency that is within a range of frequencies by varying certain physical parameters as explained below.

Figure 11:
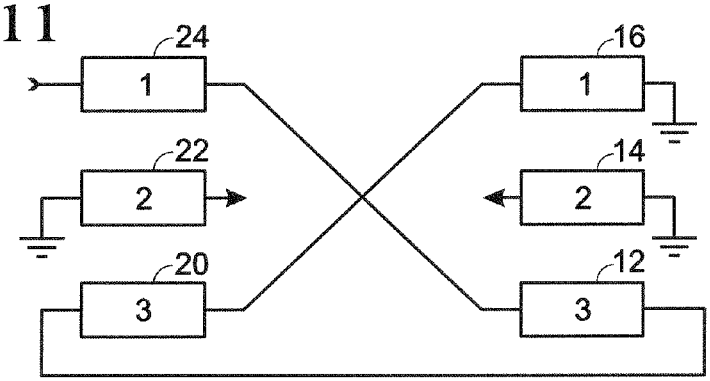
FIG. 11 is a schematic view of a balun in accordance with yet another alternate embodiment of the present invention.
Figure 13:
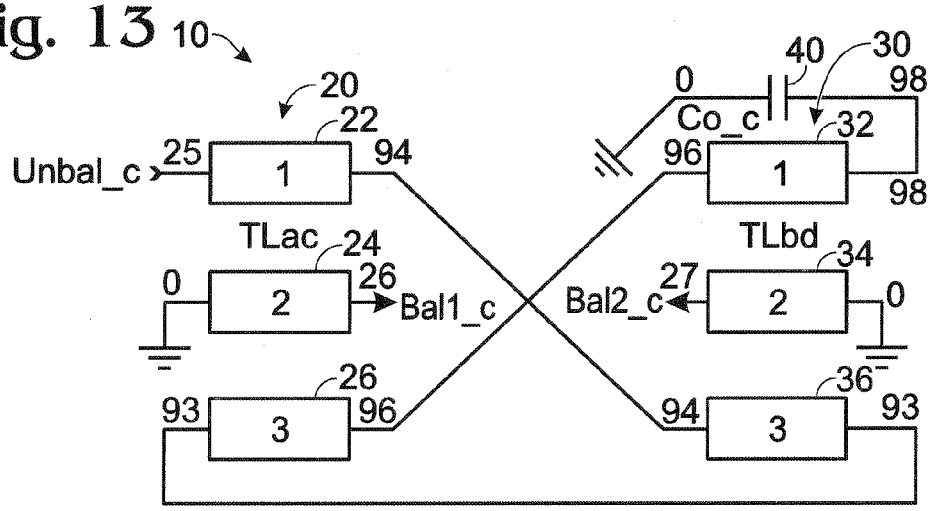
FIG. 13 is a schematic view of a balun in accordance with yet another alternate embodiment of the present invention.

Referring to FIG. 11, a schematic of a balun in accordance with an alternate embodiment of the present invention is disclosed. This embodiment is structurally identical to the balun depicted in FIG. 9. The difference between this embodiment and the one depicted in FIG. 9 is that λ/4 transmission line 16 is grounded rather than being open-circuited. The cross-over embodiments of FIGS. 11 and 13 are particularly useful for asymmetric coupler implementations. In this embodiment, the compact Marchand balun operates at a reduced nominal commensurate frequency that is nominally one quarter of the normal operating frequency of a Marchand balun of substantially the same or similar size. In practice, the nominal commensurate frequency may be selected from a frequency that is within a range of frequencies by varying certain physical parameters as explained below.

The reduced operating frequency (or commensurate frequency) of the present invention, although nominally one half or one quarter of the normal operating frequency of the conventional Marchand balun having transmission lines of the same length, i.e., is one-sixth to a quarter of the wavelength that corresponds to the operating frequency of the conventional Marchand balun. However, in practice, the reduction in frequency may be selected within a frequency range substantially centered at one-sixth to one-half the normal operating frequency by changing certain design variables.

The design variables are the even and odd mode impedances, the even and odd mode phase velocities and the even and odd mode losses, or if so preferred, the c- or pi-mode parameter equivalents. These variables correspond to design parameters such as transmission line width, distances between coupled transmission lines, distances to the corresponding ground planes, choice of dielectrics, and/or mixing dielectrics in various layers. Of course, an important design parameter is the selection of the design configuration (i.e., FIGS. 8-11) which determine whether the reduced frequency is nominally one-half the normal frequency of one-quarter the normal frequency.

Figure 12:
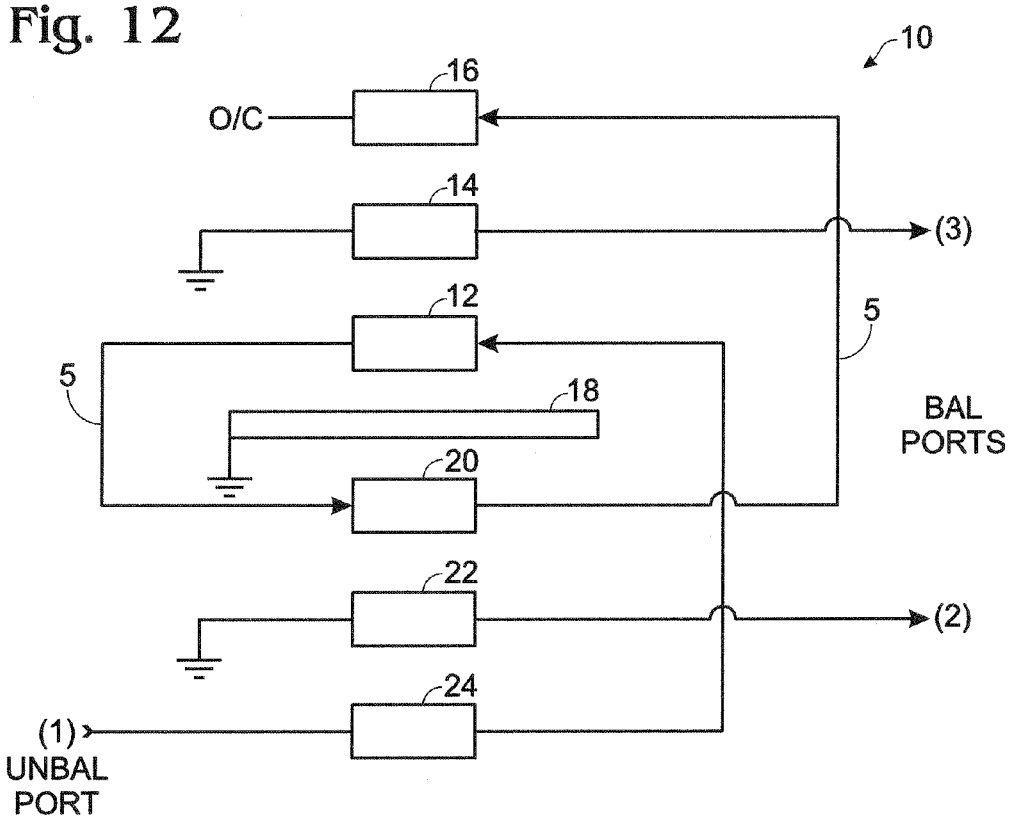
FIG. 12 is a balun model employing the three broadside coupled transmission line structure shown in FIG. 8.

Referring to FIG. 12, a cross-sectional schematic view of an implementation of the balun depicted in FIG. 8 is disclosed. In this implementation, λ/4 transmission lines 12, 14, and 16 are sandwiched together using appropriate dielectric materials disposed between each transmission line layer. In similar fashion, λ/4 transmission lines 20, 22, and 24 are sandwiched together. The two sandwiched structures are separated by ground plane 18.

As embodied herein and depicted in FIG. 13, a schematic view of a balun 10 in accordance with yet another embodiment of the present invention is shown. Balun 10 includes two interdigital couplers 20 and 30. Coupler 20 includes λ/4 transmission line 22 which is connected at one end to the unbalanced port and cross-connected to λ/4 transmission line 36 of the second coupler 30. The middle λ/4 transmission line 24 is grounded at one end and provides one of the balanced ports at the other end. The third λ/4 transmission line is cross-connected to the λ/4 transmission line 32 of coupler 30 at one end and connected to λ/4 transmission line 36 of coupler 30 at the other end thereof, in the manner shown. Note that the λ/4 transmission line 32 is also connected to ground via capacitor 40 at the other end thereof. The middle λ/4 transmission line 34 of coupler 30 provides the second balanced port at one end thereof and is grounded at the opposite end.

Figure 14:
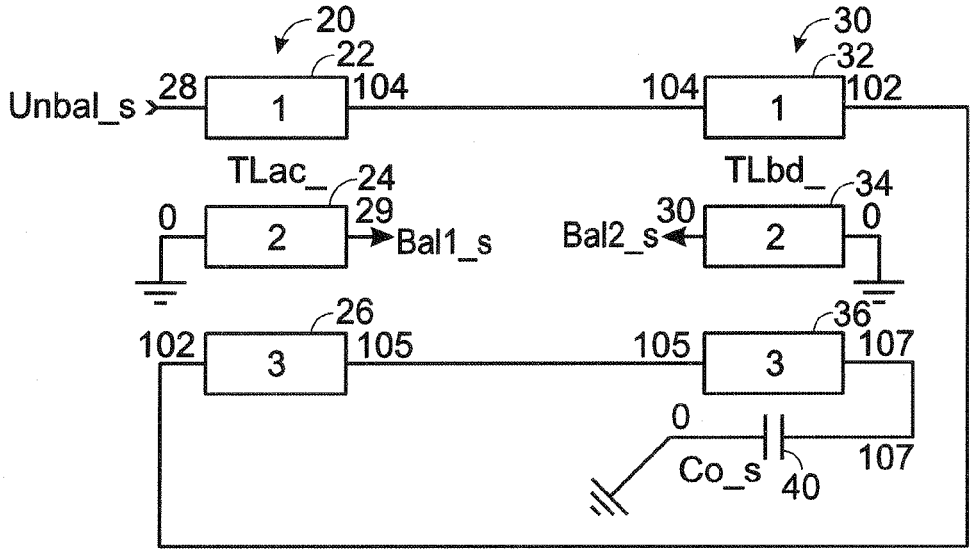
FIG. 14 is a schematic view of a balun in accordance with yet another alternate embodiment of the present invention.

Referring to FIG. 14, a schematic view of a balun 10 in accordance with yet another embodiment of the present invention is shown. FIG. 14 does not include the cross-over configuration employed in FIG. 13. λ/4 transmission line 22 includes the unbalanced port at one end, and is connected to λ/4 transmission line 32 at the other end. λ/4 transmission line 32 is connected to the input end of λ/4 transmission line 26. The opposite end of λ/4 transmission line 26 is connected to λ/4 transmission line 36. The other end of λ/4 transmission line 36 is connected to ground via capacitor 40. Both λ/4 transmission lines 24 and 34 are grounded at one end and include one of the balanced ports at the other end.

Each of the embodiments depicted in FIGS. 8-14 show two (2) sets of interdigital (e.g., three) couplers, but makes no distinction to the type of coupling (symmetric or asymmetric). In each case, the couplers may be configured as broadside or edge couplers. Furthermore, there is no distinction as to the dielectric material used with regard to any combination of dielectric constant and loss as well as magnetic permeability and magnetic loss. The baluns depicted herein may be configured to cover any parametric value combination of couplings and transmission line impedances and any value of Co (including zero) and any equivalent implementation of capacitance (stubs). The cross-over versions are particularly useful for asymmetric coupler implementations. Again, the present invention may be employed for broadside coupled implementations or edge coupled implementations.

Figure 15:
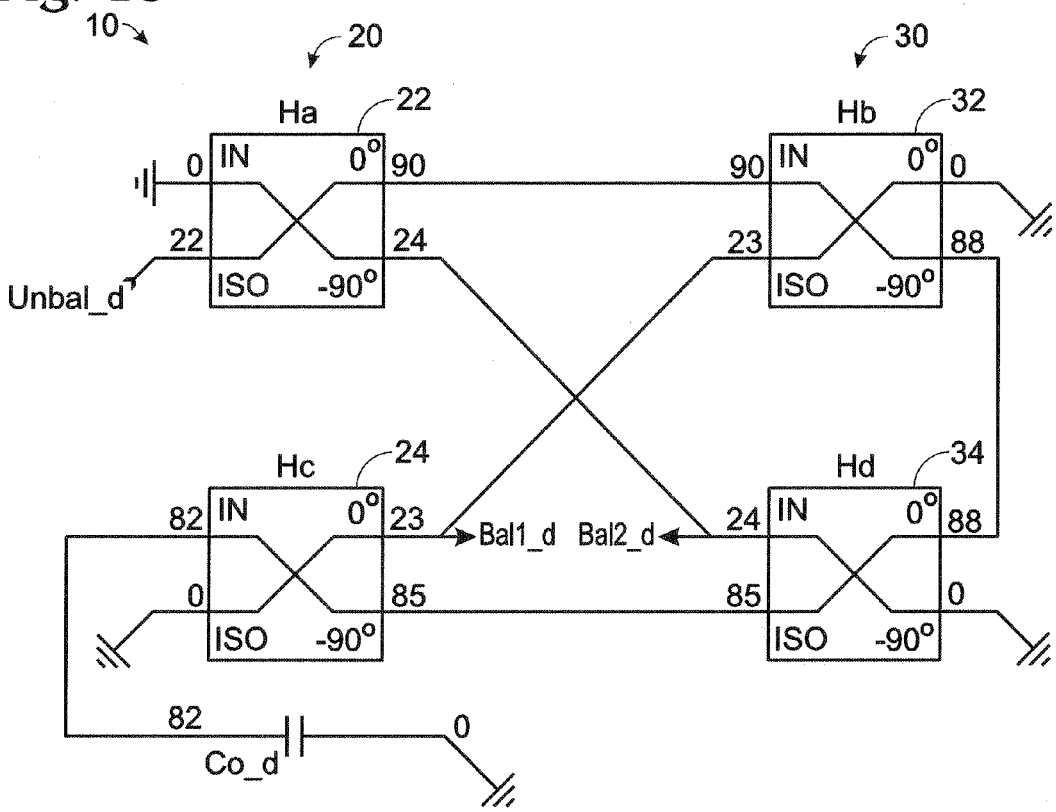
FIG. 15 is a schematic of a balun that employs discrete couplers in accordance with another embodiment of the present invention.

As embodied herein and depicted in FIG. 15, a schematic view of yet another balun 10 in accordance with the present invention is shown. In this embodiment, balun 10 is implemented with discrete couplers 22, 24, 32, 34 in the manner depicted. This embodiment makes no distinction as to the coupling values, symmetry and frequency of operation of each of the couplers and does not necessarily arrive at a real balanced impedance. Any imaginary part will have to be a part of a matching network if a real impedance is required. In the simplest case, a capacitor similar to capacitor 706 in FIG. 7A would be applied between the balanced port set to turn the impedance to purely real.

Figure 16:
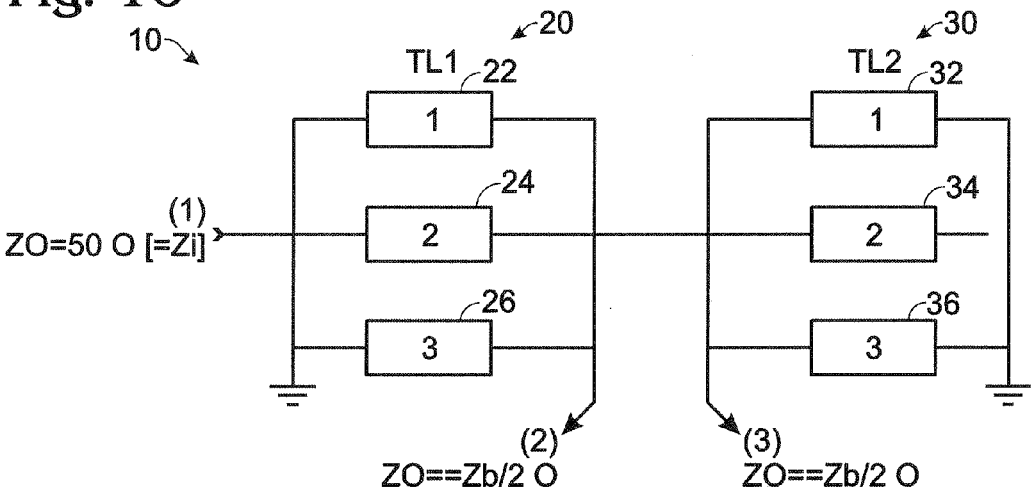
FIG. 16 is a schematic of a balun employing interdigital couplers for representation only.
Figure 17:
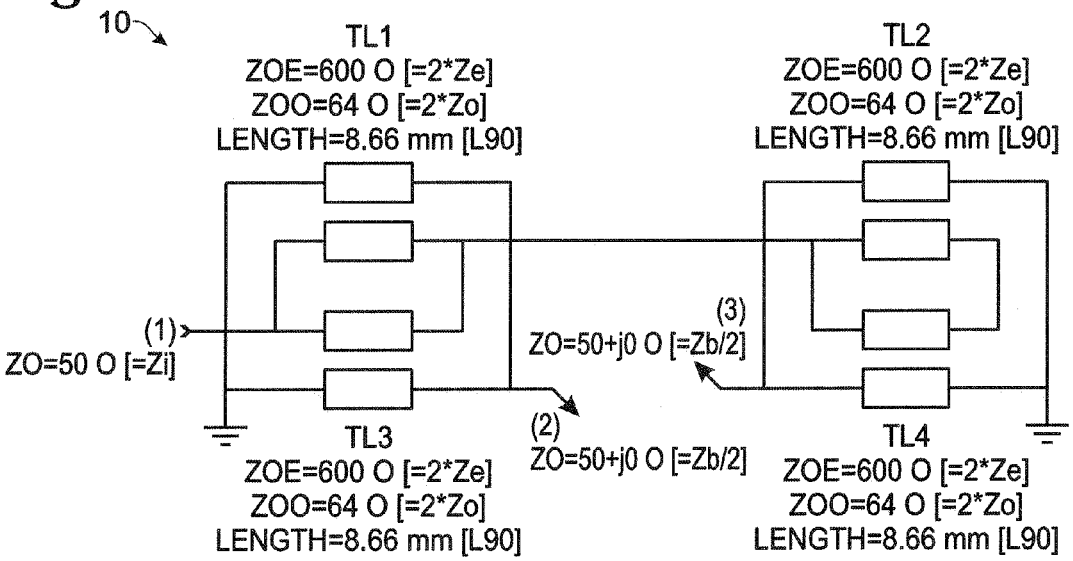
FIG. 17 is a schematic of a balun model for the device depicted in FIG. 16.
Figure 18:
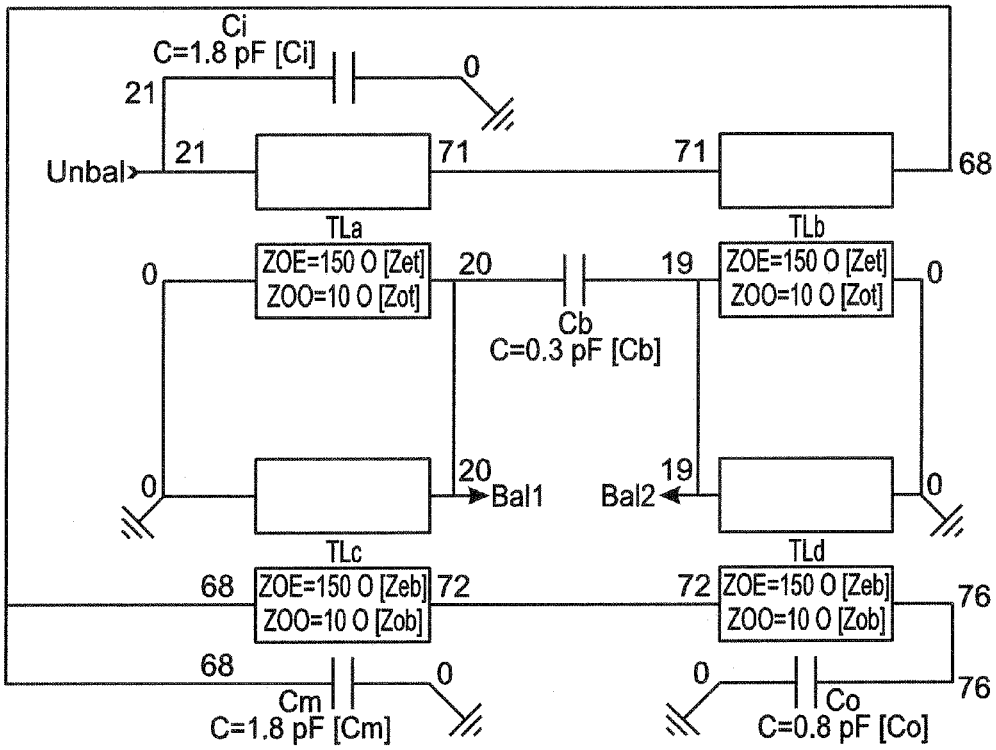
FIG. 18 is a schematic of a generic balun model derived from the schematic representations depicted in FIG. 6A, FIG. 16 and FIG. 17.

FIG. 16 is a schematic of a Marchand balun employing interdigital couplers for representation only. FIG. 16 is employed as a means for the theoretical development of a freely frequency tunable embodiment of the present invention as depicted in FIGS. 16-18. In FIG. 16 it is assumed that the three coupled transmission lines are broadside coupled.

FIG. 17 is an approximated model of the structure depicted in FIG. 16 and includes two parallel connected coupled line pairs. It can be shown that the impedances needed for the individual lines for the interdigital broadside coupled lines as compared to the impedances required needed for a two (2) broad side coupled line implementation are twice as high. This is equivalent to cutting the trace width of the coupled lines in half. For a spiraled implementation this reduces the pitch between turns significantly and thus saves significant x-y size. It is possible to have different even and odd mode impedance for each section of coupled transmission line as well as different lengths. A difference in length from left to right may be used to fix, or preset, the balanced performance of the balun, whereas a difference from top to bottom is useful in obtaining a desired frequency response. In the following development, only the latter (top-to-bottom) will be described. The left/right adjustment is considered part of design tuning rather than a design parameter. An exception to this is designing for a deliberate amount of imbalance. Also in the exemplary embodiment described herein, the different top to bottom parameters may be employed to alleviate the effect of an imperfect profile. Thus having established the usefulness of having different parameters from top to bottom, the following generic parameterized model is chosen:

Referring to FIG. 18, the generic parameterized model has four different coupled transmission line sections; TLa, TLb, TLc, and TLd. This embodiment of the present invention has two basic realizations. The first is a realization of the structure (or any of its variations) using discrete and individually designed coupled transmission lines. In the second exemplary embodiment, one of the transmission lines from each top and bottom coupled section is shared, such that the entire structure is made up of just three coupled lines.

TLa and TLb are characterized here by the same even and odd mode impedances (Zet, Zot). Similarly, the coupled transmission lines TLc and TLd are also characterized by the same even and odd mode impedances (Zeb, Zob). For this analysis the length of each of the coupled sections is assumed identical, although this is not a specific requirement. In fact, a typical implementation may have some variation in lengths. In addition to the capacitor Cb disposed between the balanced ports, the structure of FIG. 18 includes three (3) additional capacitors. One capacitor Ci is disposed at the unbalanced port of the structure; another capacitor Cm is disposed in the middle of the unbalanced transmission line path, where the traditional Marchand input path ends and the structure of this invention "re-couples." The third capacitor Co is disposed at the end of the unbalanced transmission line path, after re-coupling is completed. Depending on the desired performance of the structure, some or all of the capacitors can be eliminated. The capacitors may also be implemented as stubs. This embodiment may be freely scaled in frequency. Because the capacitance values need to change with frequency they are here forth given as $C=\lambda_{freespace[mm]}C_{pF/mm}$ pF/mm, i.e., pico Farads per millimeter of wavelength in free space. FIGS. 19-26 show various embodiments derived from the model depicted in FIG. 18.

Before turning to FIGS. 19-26, it must be again be noted that each of the coupler structures may be implemented in a variety of ways that include discrete couplers, individually designed coupled transmission lines, or the interdigital (three) coupled line structures whereby one of the transmission lines from each top and bottom coupled section is shared.

Figure 19:
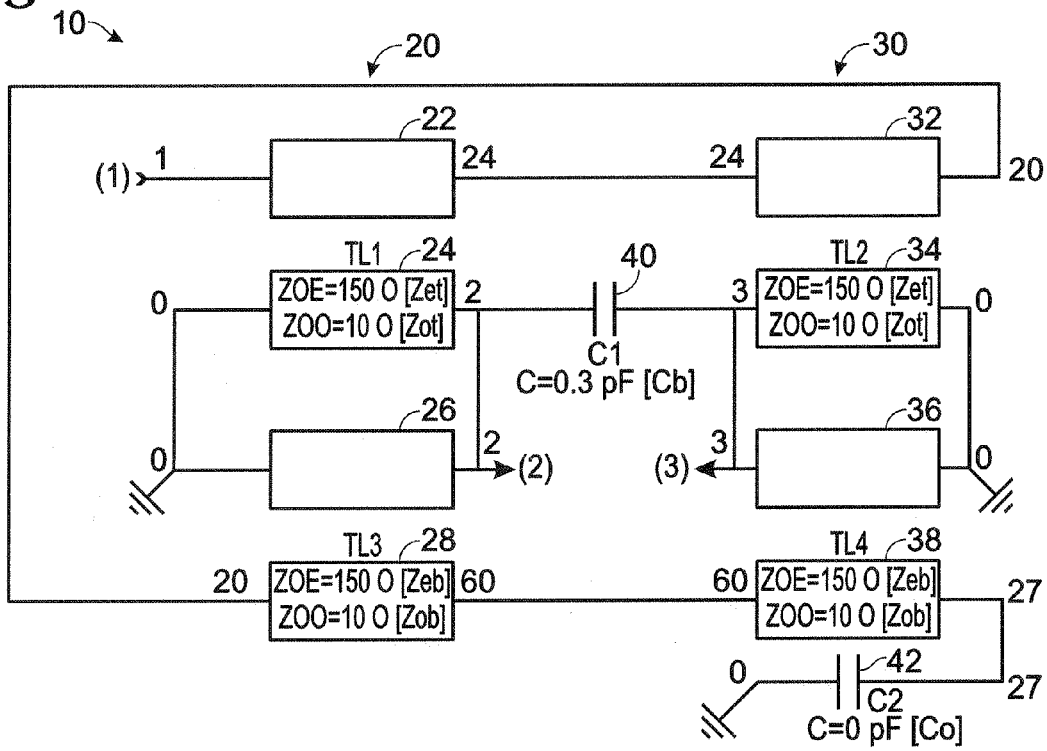
FIG. 19 is a schematic of an alternate balun implementation in accordance with the present invention.

Referring to FIG. 19, a schematic of an alternate balun implementation in accordance with the present invention is shown. This embodiment represents a straight configuration. The first coupled structure 20*m* includes λ/4 transmission line 22, λ/4 transmission line 24, λ/4 transmission line 26, and λ/4 transmission line 28. The second coupled structure 30 includes λ/4 transmission line 32, λ/4 transmission line 34, λ/4 transmission line 36, and λ/4 transmission line 38. Capacitor 40 is disposed between the balanced ports, and capacitor 42 is disposed at the end of the unbalanced transmission line path. Again, the implementation of FIG. 19 may be realized using the three coupled lines of the interdigital scheme or with discrete couplers.

Figure 20:
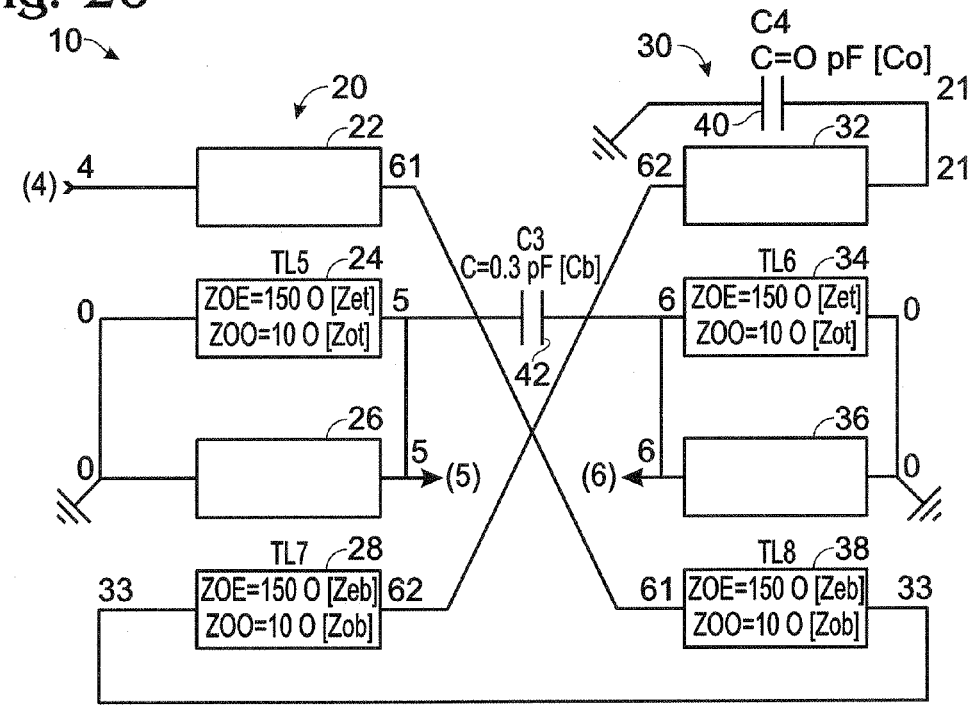
FIG. 20 is a schematic of an alternate balun implementation in accordance with the present invention.

FIG. 20 is a schematic of an alternate balun implementation in accordance with the present invention. This embodiment features a cross-over in the unbalanced path. In particular, λ/4 transmission line 22 of coupler structure 20 is connected λ/4 transmission line 38 of coupler structure 30. Similarly, λ/4 transmission line 28 is connected to λ/4 transmission line 32. The unbalanced path includes capacitor 40 which is disposed between λ/4 transmission line 32 and ground. A second capacitor 42 is disposed between the balanced ports. Again, the implementation of FIG. 20 may be realized using the three coupled lines of the interdigital scheme or with discrete couplers.

Figure 21:
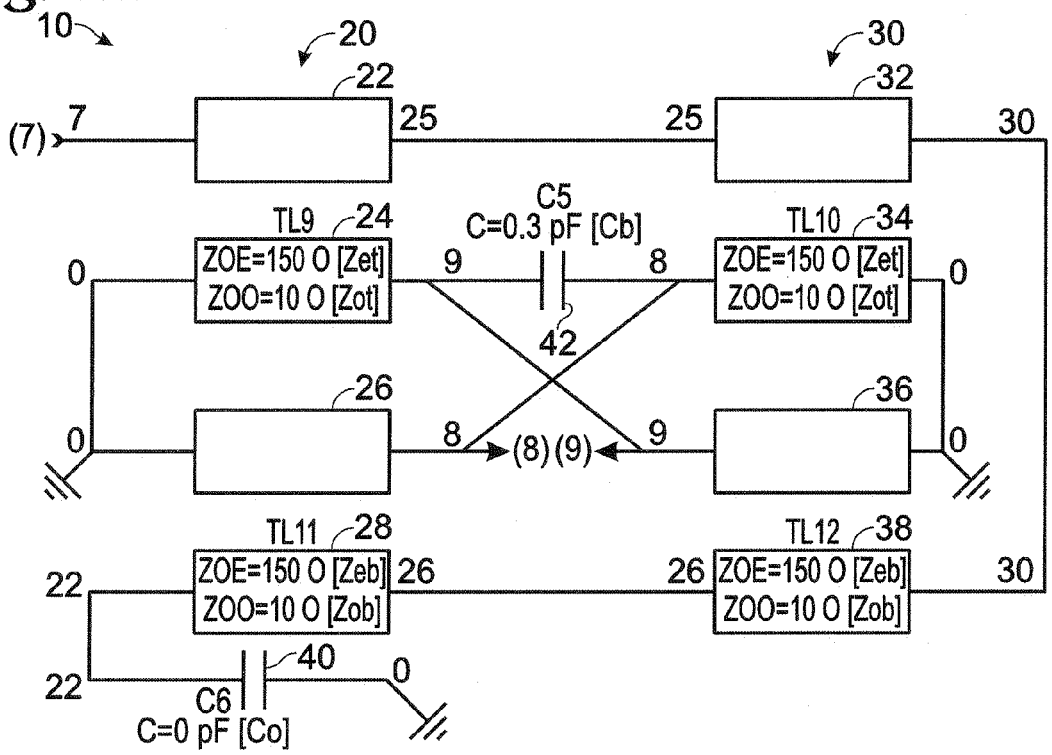
FIG. 21 is a schematic of an alternate balun implementation in accordance with the present invention.

FIG. 21 is a schematic of an alternate balun implementation in accordance with the present invention. This embodiment is similar to the embodiment shown in FIG. 19. This embodiment represents an alternative straight configuration. There are two capacitors (40, 42) in the unbalanced path. Capacitor 42 is disposed between the balanced ports formed by the internal ends of λ/4 transmission line 24 and λ/4 transmission line 34. Capacitor 40 is disposed between λ/4 transmission line 28 and ground. Again, the implementation of FIG. 21 may be realized using the three coupled lines of the interdigital scheme, or with discrete couplers.

Figure 22:
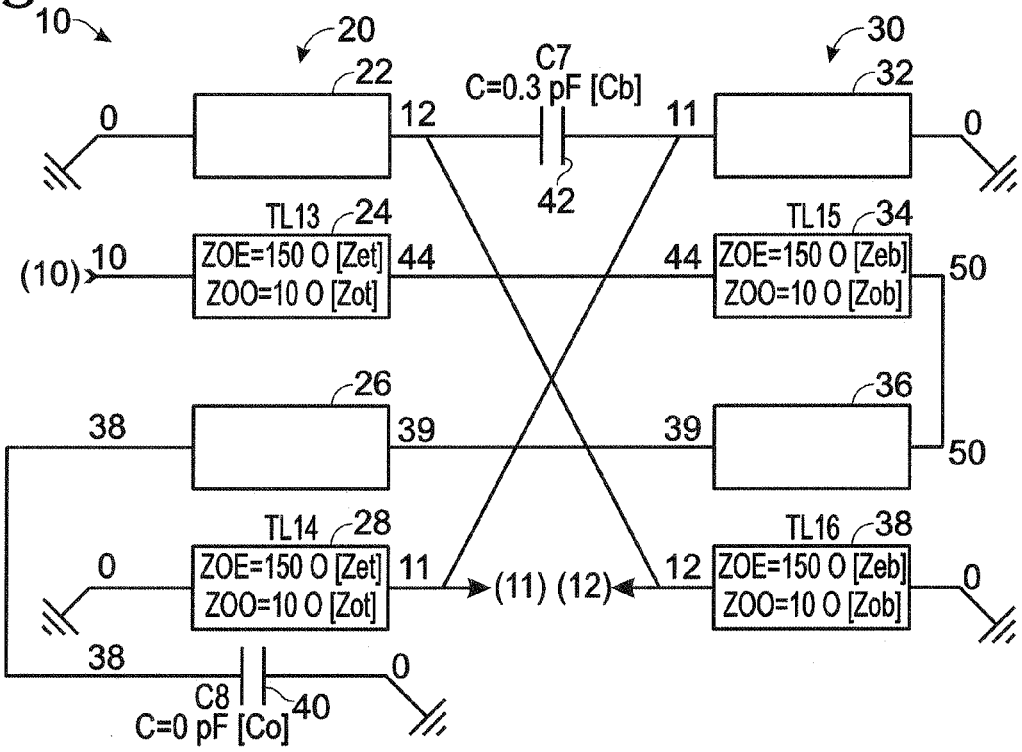
FIG. 22 is a schematic of an alternate balun implementation in accordance with the present invention.

FIG. 22 is yet another schematic of an alternate balun implementation in accordance with the present invention. This embodiment represents another alternative straight configuration. The unbalanced path includes the unbalanced port, λ/4 transmission line 24, λ/4 transmission line 34, λ/4 transmission line 36, λ/4 transmission line 26, and capacitor 40, which is also coupled to ground. The balanced ports are cross-connected between λ/4 transmission line 22 and 38, and between λ/4 transmission line 32 and 28. Capacitor 42 is also disposed between λ/4 transmission line 22 and λ/4 transmission line 32. Again, the implementation of FIG. 22 may be realized using the three coupled lines of the interdigital scheme, or with discrete couplers.

Figure 23:
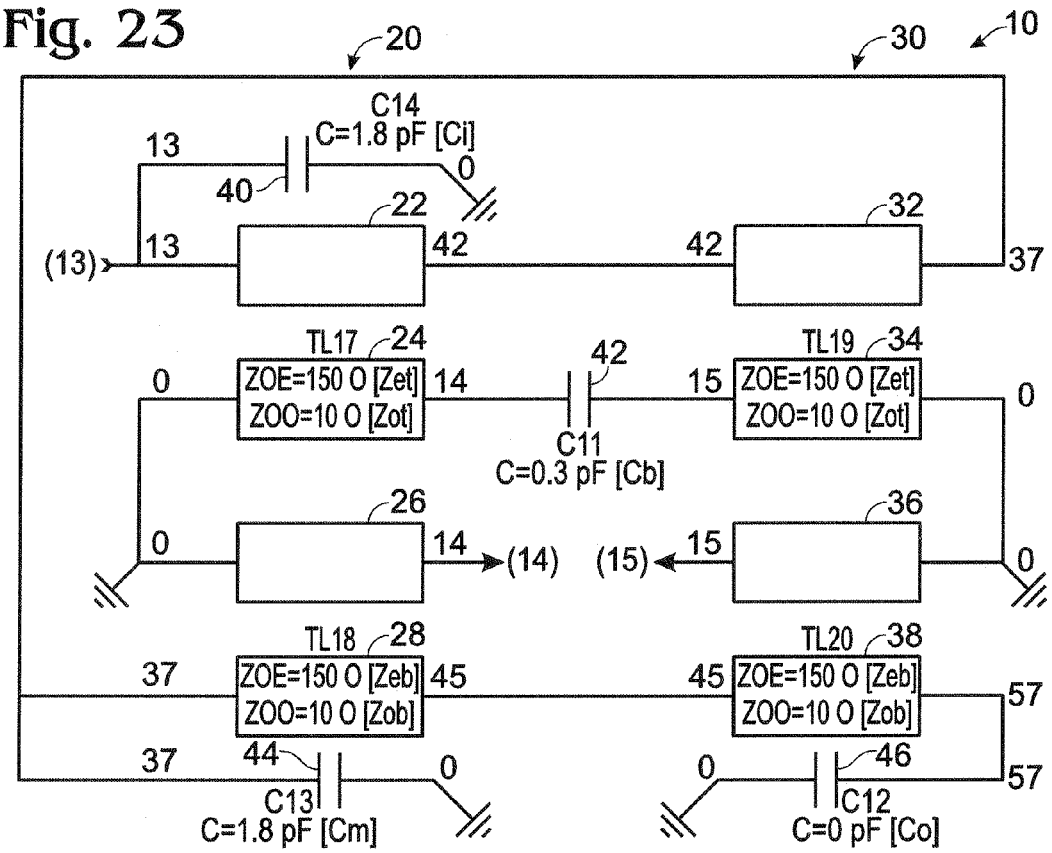
FIG. 23 is a schematic of an alternate balun implementation in accordance with the present invention.

FIG. 23 is a schematic of an alternate balun implementation in accordance with the present invention. This embodiment features increased tunability by including four capacitors. Additional capacitance is provided at the input (40), middle (44), and end (46) of the input path. Capacitance 42 is also provided between the balanced ports. Again, the implementation of FIG. 23 may be realized using the three coupled lines of the interdigital scheme, or with discrete couplers.

Figure 24:
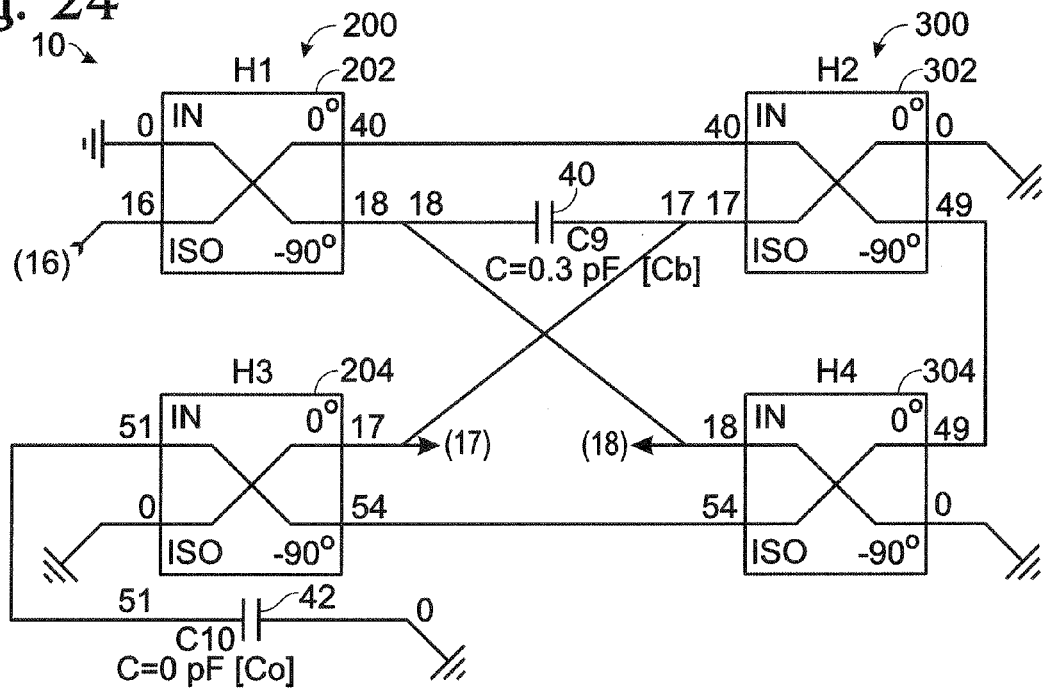
FIG. 24 is a schematic of an alternate balun implementation in accordance with the present invention.

FIG. 24 is a schematic of an alternate balun implementation in accordance with the present invention. This embodiment is realized by employing discrete X-style hybrid couplers (202, 204, 302, 304). This embodiment includes capacitors 40, 42 disposed in the balun as shown in FIG. 24.

Figure 25:
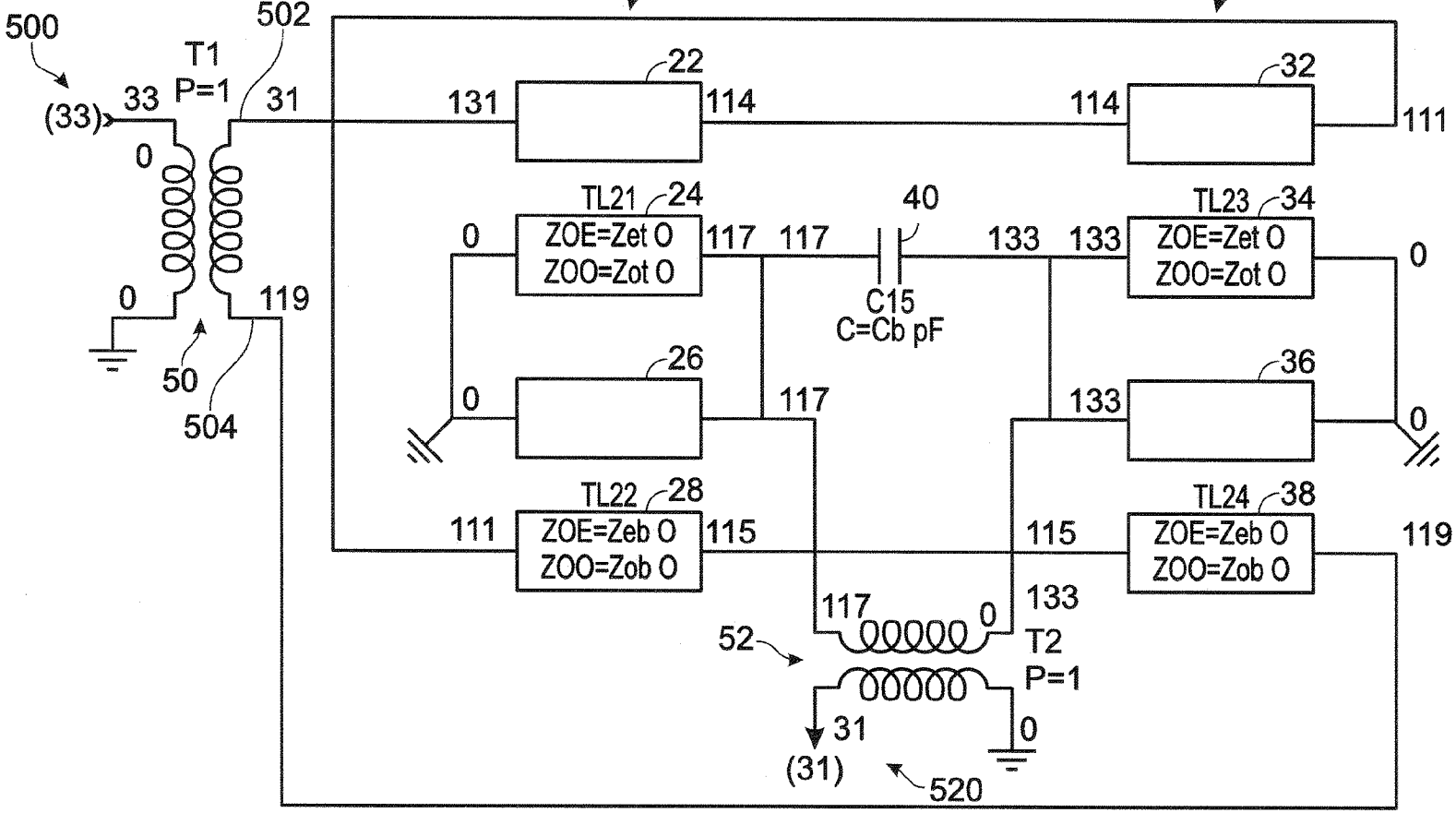
FIG. 25 is a schematic of an alternate balun implementation in accordance with the present invention.

Referring to FIG. 25, a schematic of an alternate balun implementation in accordance with the present invention is depicted. Note that the design parameters are different for this embodiment. The secondary of transformer 50 is connected across one of the transmission line paths, whereas transformer 52 is in series with the transmission lines of the second transmission line path. In particular, balanced port 500 is connected to the primary; the other end of the primary is connected to ground. The secondary (at 502) is connected to λ/4 transmission line 22, which is connected in series with λ/4 transmission line 32, λ/4 transmission line 28, and λ/4 transmission line 38. λ/4 transmission line 38 is connected to the opposite end 504 of the secondary of transformer 50. Balanced port 520 is similarly connected to the primary of transformer 52; the other end of the primary is connected to ground. The secondary of transformer 52 is connected between λ/4 transmission line 26 and λ/4 transmission line 36. Capacitor 40 is connected between λ/4 transmission line 24 and λ/4 transmission line 34.

Figure 26:
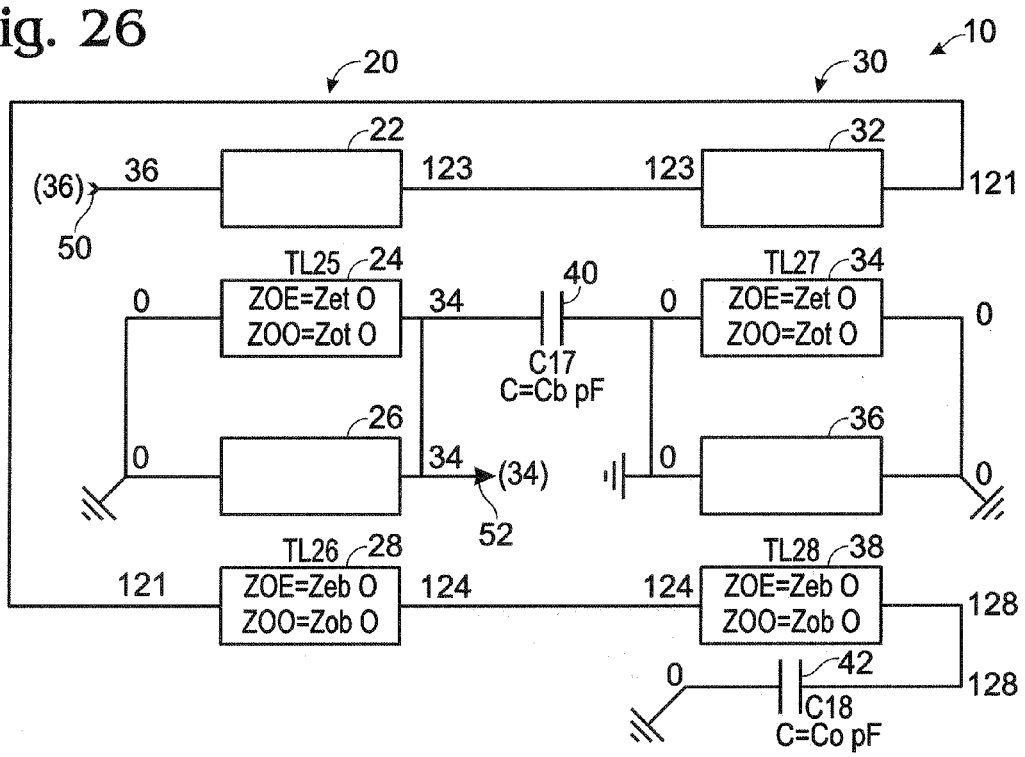
FIG. 26 is a schematic of an alternate balun implementation in accordance with the present invention.

FIG. 26 is a schematic of an alternate balun implementation in accordance with the present invention. This embodiment illustrates single ended to single ended operation. Port 50 is disposed in series with λ/4 transmission lines 22, 32, 28 and 38. λ/4 transmission line 38 is coupled to ground via capacitor 42. Port 52 is connected to λ/4 transmission line 26. The opposite end of λ/4 transmission line 26 is grounded. One end of λ/4 transmission line 24 is also grounded. The opposite end is connected to capacitor 40 which is, in turn, connected to λ/4 transmission line 34. The opposite end of λ/4 transmission lines 34 is grounded. Both ends of λ/4 transmission line 36 are grounded.

The various embodiments depicted heretofore are merely representative examples of the teachings of the present invention, and the present invention should not be construed as being limited thereby. Table I provides useful design numbers for symmetric broadside coupled realizations. Note that Zi is the single ended port impedance, Zbal is the balanced port impedance, and therefore, each of the individual ports of the balanced port have an impedance of $Z_{bal,1}=Z_{bal,2}=Z_{bal}/2$. $F_0$ is the nominal center frequency that would be dictated by the transmission line lengths. $F_1$ and $F_2$ represent the lower and upper frequency of a band width measure at, at least 18 dB return loss. Thus $F_1/F_0$ and $F_2/F_0$ are the normalized start and stop frequencies. The effective relative wavelength is calculated as the nominal center frequency $F_0$ over the average of $F_1$ and $F_2$. The 18 dB return loss bandwidth is calculated as the difference between $F_1$ and $F_2$ over the average of $F_1$ and $F_2$ and is presented in percent. Although adding the capacitance $C_i$ and $C_m$ may be useful, design numbers are not provided here. Also some of the numbers given above have even mode values above what would typically be achievable in the preferred embodiment, but are included for reference.

TABLE I

| Zi [Ohm] | Zbal [Ohm] | Ze top [Ohm] | Zo top [Ohm] | Ze bot [Ohm] | Zo bot [Ohm] | $C_b$ [pF/mm] | $C_o$ [pF/mm] | F1/F0 [ ] | F2/F0 [ ] | Eff Rel Wave Len 2 * F0/(F2 + F1) [ ] | BW 2 * (F2 − F1)/(F2 + F1) |
|---|---|---|---|---|---|---|---|---|---|---|---|
| 50 | 12.5 | 120 | 14.75 | 120 | 14.75 | 0.0 | 0.0 | 0.43 | 0.48 | 2.22 | 11% |
| 50 | 12.5 | 300 | 16.5 | 300 | 16.5 | 0.0 | 0.0 | 0.41 | 0.48 | 2.24 | 15% |
| 50 | 12.5 | 480 | 17 | 480 | 17 | 0.0 | 0.0 | 0.41 | 0.48 | 2.24 | 16% |
| 50 | 12.5 | 1200 | 17.75 | 1200 | 17.75 | 0.0 | 0.0 | 0.41 | 0.48 | 2.25 | 17% |
| 50 | 12.5 | Inf | 18 | Inf | 18 | 0.0 | 0.0 | 0.41 | 0.48 | 2.25 | 17% |
| 50 | 12.5 | 480 | 18 | 480 | 18 | 0.0 | 10.8 | 0.34 | 0.41 | 2.68 | 20% |
| 50 | 12.5 | 480 | 18.5 | 480 | 18.5 | 0.0 | 21.7 | 0.28 | 0.36 | 3.13 | 23% |
| 50 | 12.5 | 480 | 18.5 | 480 | 18.5 | 0.0 | 43.3 | 0.22 | 0.30 | 3.85 | 31% |
| 50 | 12.5 | 480 | 18 | 480 | 18 | 0.0 | 86.6 | 0.16 | 0.25 | 4.91 | 43% |
| 50 | 12.5 | 480 | 16 | 480 | 16 | 0.0 | 173.2 | 0.11 | 0.21 | 6.20 | 64% |
| 50 | 12.5 | 480 | 14 | 480 | 14 | 0.0 | 346.4 | 0.08 | 0.18 | 7.77 | 76% |
| 50 | 12.5 | 600 | 20 | 600 | 20 | 108.3 | 692.8 | 0.06 | 0.24 | 6.67 | 123% |
| 50 | 25 | 120 | 16 | 120 | 16 | 0.0 | 0.0 | 0.33 | 0.40 | 2.74 | 19% |
| 50 | 25 | 140 | 18 | 140 | 18 | 0.0 | 0.0 | 0.33 | 0.42 | 2.67 | 23% |
| 50 | 25 | 180 | 20 | 180 | 20 | 0.0 | 0.0 | 0.33 | 0.43 | 2.67 | 27% |
| 50 | 25 | 240 | 22 | 240 | 22 | 0.0 | 0.0 | 0.31 | 0.43 | 2.71 | 31% |
| 50 | 25 | 300 | 23 | 300 | 23 | 0.0 | 0.0 | 0.30 | 0.43 | 2.76 | 34% |
| 50 | 25 | 360 | 24 | 360 | 24 | 0.0 | 0.0 | 0.30 | 0.43 | 2.76 | 34% |
| 50 | 25 | 480 | 25 | 480 | 25 | 0.0 | 0.0 | 0.30 | 0.43 | 2.76 | 34% |
| 50 | 25 | 720 | 26 | 720 | 26 | 0.0 | 0.0 | 0.30 | 0.43 | 2.76 | 34% |
| 50 | 25 | 1200 | 28 | 1200 | 28 | 0.0 | 0.0 | 0.29 | 0.41 | 2.88 | 34% |
| 50 | 25 | Inf | 31 | Inf | 31 | 0.0 | 0.0 | 0.29 | 0.39 | 2.96 | 30% |
| 50 | 25 | 480 | 30 | 480 | 30 | 0.0 | 10.8 | 0.19 | 0.28 | 4.28 | 35% |
| 50 | 25 | 480 | 34 | 480 | 34 | 0.0 | 21.7 | 0.14 | 0.20 | 5.88 | 32% |
| 50 | 25 | 420 | 30 | 420 | 30 | 41.1 | 43.3 | 0.11 | 0.28 | 5.10 | 85% |
| 50 | 25 | 260 | 26 | 260 | 26 | 74.7 | 86.6 | 0.10 | 0.30 | 5.06 | 101% |
| 50 | 25 | 380 | 38 | 380 | 38 | 192.7 | 173.2 | 0.06 | 0.12 | 11.27 | 65% |
| 50 | 25 | 400 | 40 | 400 | 40 | 108.3 | 108.3 | 0.06 | 0.17 | 8.65 | 92% |
| 50 | 25 | 600 | 62 | 600 | 62 | 281.5 | 216.5 | 0.04 | 0.09 | 16.33 | 78% |
| 50 | 50 | 180 | 10 | 180 | 10 | 0.0 | 0.0 | 0.18 | 0.21 | 5.08 | 16% |
| 50 | 50 | 300 | 18 | 300 | 18 | 0.0 | 0.0 | 0.17 | 0.22 | 5.16 | 26% |
| 50 | 50 | 480 | 34 | 480 | 34 | 0.0 | 0.0 | 0.19 | 0.24 | 4.57 | 23% |
| 50 | 50 | 720 | 72 | 720 | 72 | 0.0 | 0.0 | 0.23 | 0.26 | 4.10 | 10% |
| 50 | 50 | 241.4 | 41.4 | 241.4 | 41.4 | 18.4 | 0.0 | 0.24 | 0.38 | 3.27 | 45% |
| 50 | 50 | 120.7 | 20.7 | 120.7 | 20.7 | 54.1 | 0.0 | 0.34 | 0.43 | 2.61 | 25% |
| 50 | 50 | 160 | 30 | 160 | 30 | 18.4 | 0.0 | 0.27 | 0.53 | 2.50 | 66% |
| 50 | 50 | 240 | 36 | 240 | 36 | 16.2 | 0.0 | 0.22 | 0.46 | 2.92 | 70% |
| 50 | 50 | 340 | 36 | 340 | 36 | 11.9 | 0.0 | 0.22 | 0.49 | 2.84 | 78% |
| 50 | 50 | 420 | 42 | 420 | 42 | 11.9 | 0.0 | 0.27 | 0.40 | 3.01 | 41% |
| 50 | 50 | 240 | 44 | 240 | 44 | 35.7 | 10.8 | 0.16 | 0.32 | 4.21 | 67% |
| 50 | 50 | 280 | 60 | 280 | 60 | 60.6 | 21.7 | 0.12 | 0.21 | 6.06 | 58% |
| 50 | 50 | 280 | 68 | 280 | 68 | 116.9 | 43.3 | 0.09 | 0.15 | 8.42 | 48% |
| 50 | 50 | 420 | 112 | 420 | 112 | 230.6 | 86.6 | 0.06 | 0.08 | 14.55 | 40% |
| 50 | 100 | 180 | 48 | 180 | 48 | 26.0 | 0.0 | 0.24 | 0.33 | 3.48 | 30% |
| 50 | 100 | 240 | 62 | 240 | 62 | 21.7 | 0.0 | 0.21 | 0.34 | 3.60 | 47% |
| 50 | 100 | 300 | 74 | 300 | 74 | 18.4 | 0.0 | 0.21 | 0.33 | 3.68 | 44% |
| 50 | 100 | 480 | 128 | 480 | 128 | 10.8 | 0.0 | 0.23 | 0.27 | 4.00 | 15% |
| 50 | 100 | 240 | 84 | 240 | 84 | 50.9 | 10.8 | 0.15 | 0.21 | 5.52 | 34% |
| 50 | 100 | 300 | 118 | 300 | 118 | 82.3 | 21.7 | 0.11 | 0.15 | 7.92 | 30% |
| 50 | 200 | 180 | 78 | 180 | 78 | 27.1 | 0.0 | 0.26 | 0.29 | 3.68 | 11% |
| 50 | 200 | 240 | 98 | 240 | 98 | 21.7 | 0.0 | 0.23 | 0.29 | 3.81 | 24% |
| 50 | 200 | 300 | 120 | 300 | 120 | 18.4 | 0.0 | 0.23 | 0.29 | 3.86 | 27% |
| 50 | 200 | 360 | 144 | 360 | 144 | 15.2 | 0.0 | 0.23 | 0.28 | 3.95 | 22% |
| 50 | 200 | 300 | 120 | 300 | 120 | 18.4 | 0.0 | 0.23 | 0.29 | 3.86 | 27% |
| 50 | 200 | 300 | 154 | 300 | 154 | 53.0 | 10.8 | 0.14 | 0.17 | 6.67 | 20% |
| 100 | 400 | 500 | 200 | 500 | 200 | 10.8 | 0.0 | 0.23 | 0.30 | 3.85 | 27% |
| 25 | 100 | 180 | 72 | 180 | 72 | 313.9 | 0.0 | 0.22 | 0.29 | 3.88 | 27% |
| 100 | 100 | 340 | 56 | 340 | 56 | 8.7 | 0.0 | 0.25 | 0.58 | 2.43 | 80% |

TABLE II

| Zi [Ohm] | Zbal [Ohm] | Ze top [Ohm] | Zo top [Ohm] | Ze bot [Ohm] | Zo bot [Ohm] | Cb [pF/mm] | Co [pF/mm] | F1/F0 [ ] | F2/F0 [ ] | Eff Rel Wave Len 2 * F0/(F2 + F1) [ ] | BW 2 * (F2 − F1)/(F2 + F1) |
|---|---|---|---|---|---|---|---|---|---|---|---|
| Straight configuration | | | | | | | | | | | |
| 50 | 25 | 720 | 27.9 | 320 | 11.61 | 21.7 | 39.0 | 0.09 | 0.66 | 2.67 | 153% |
| 50 | 25 | 320 | 30 | 500 | 13.33 | 21.7 | 39.0 | 0.08 | 0.57 | 3.07 | 149% |
| 50 | 50 | 208 | 33.6 | 492 | 23.33 | 9.7 | 0.0 | 0.19 | 0.62 | 2.48 | 108% |
| 50 | 50 | 192 | 51.2 | 533.3 | 20 | 32.5 | 10.8 | 0.13 | 0.28 | 4.88 | 71% |
| 50 | 100 | 154 | 82.5 | 510 | 52.8 | 33.6 | 7.6 | 0.17 | 0.25 | 4.76 | 40% |
| 50 | 100 | 143 | 98.6 | 472 | 46.9 | 60.6 | 18.4 | 0.14 | 0.18 | 6.30 | 24% |
| 50 | 100 | 300 | 34.1 | 133.3 | 112.7 | 13.0 | 0.0 | 0.27 | 0.46 | 2.74 | 53% |
| 50 | 100 | 330 | 40.7 | 146.7 | 134.5 | 37.9 | 10.8 | 0.17 | 0.25 | 4.73 | 39% |
| 50 | 100 | 330 | 40.7 | 146.7 | 134.5 | 37.9 | 10.8 | 0.10 | 0.15 | 7.73 | 39% |
| 50 | 200 | 180 | 96 | 320 | 66.67 | 23.8 | 0.0 | 0.23 | 0.28 | 3.98 | 19% |
| Cross-over configuration | | | | | | | | | | | |
| 50 | 25 | 525 | 37.2 | 336 | 15.48 | 16.2 | 26.0 | 0.15 | 0.35 | 4.02 | 81% |
| 50 | 25 | 196 | 28 | 400 | 28 | 35.7 | 27.1 | 0.15 | 0.34 | 4.12 | 76% |
| 50 | 25 | 224 | 28 | 457 | 28 | 61.7 | 60.6 | 0.10 | 0.30 | 5.06 | 104% |
| 50 | 25 | 256 | 32.5 | 400 | 20.8 | 61.7 | 60.6 | 0.10 | 0.33 | 4.68 | 111% |
| 50 | 25 | 288 | 36.4 | 355.6 | 18.57 | 83.4 | 108.3 | 0.08 | 0.28 | 5.59 | 108% |
| 50 | 50 | 598 | 37.2 | 452.2 | 15.48 | 0.0 | 0.0 | 0.16 | 0.65 | 2.47 | 120% |
| 50 | 50 | 520 | 34.8 | 307.7 | 16.55 | 0.0 | 0.0 | 0.19 | 0.62 | 2.49 | 107% |
| 50 | 50 | 468 | 51 | 276.9 | 17.65 | 19.5 | 9.7 | 0.14 | 0.35 | 4.08 | 86% |
| 75 | 75 | 300 | 43.7 | 300 | 48.42 | 11.9 | 0.0 | 0.23 | 0.54 | 2.62 | 82% |
| 50 | 100 | 154 | 82.5 | 510 | 52.8 | 33.6 | 7.6 | 0.17 | 0.25 | 4.76 | 40% |

Table II provides useful design numbers for asymmetric broadside coupled realizations. Again $F_1$ and $F_2$ spans an 18 dB return loss bandwidth. Asymmetric coupling structures may be used to achieve desired performance requirements by compensating for, or enhancing, effects such as even and odd mode phase velocity differences and or degenerate groundplanes. Cross-over configurations may be particularly useful for these purposes. The present invention also contemplates dual band baluns with a much wider range of frequency separation than is possible for standard Marchand baluns. Both the symmetric embodiments and the unsymmetrical embodiments may be employed for this purpose.

In an earlier discussion, the present invention discussed the so-called "real estate" required to implement a capacitor in any given design. In reference to FIGS. 27 and 28, the capacitor/open stubs attached between/to the balanced output can be viewed as simply a part of a matching network. Thus assuming that a matching network is required in the system to get the balanced load impedance from a complex impedance to a real impedance, this capacitance can be incorporated into the matching network as described below.

Figure 27:
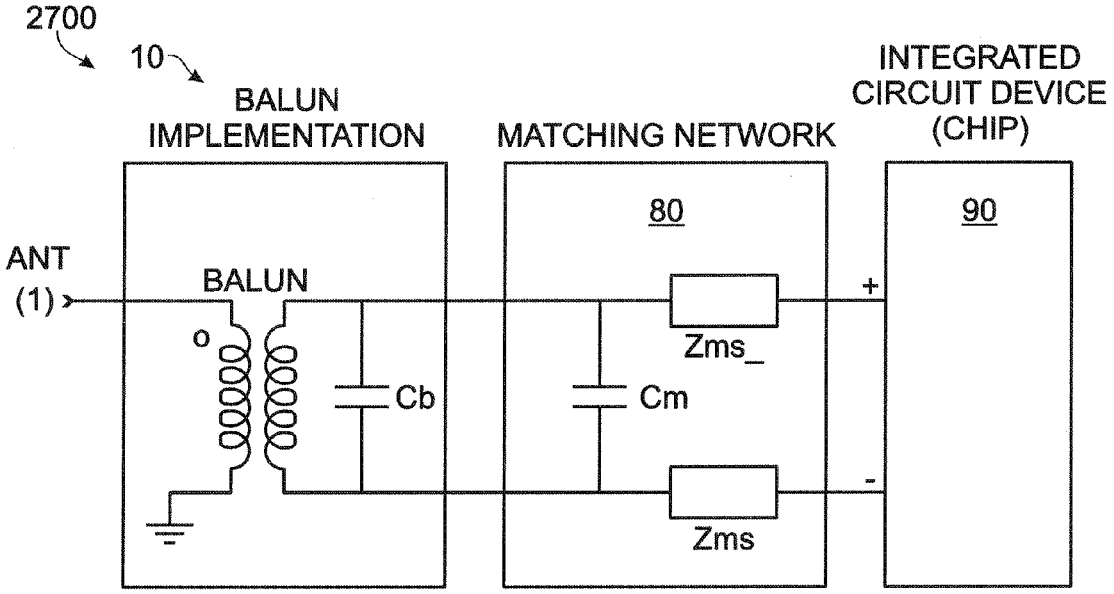
FIG. 27 is a schematic illustrating a typical application using the balun in accordance with the present invention.

As shown in FIG. 27, a matching network 80 is disposed between the balun 10 and the RF IC device 90 disposed on the RF assembly circuit board. As those of ordinary skill in the art will appreciate, the schematic represents the end-customer's RF assembly. In this view, the customer procures the balun 10 for use with the RF IC device 90, such as low-noise amplifier (LNA). In this example, an unbalanced RF signal is being transmitted from an antenna (ANT). The balun 10 converts the RF signal into balanced differential output signals for use in the RF receiver 90. The balun shown in this implementation is configured to eliminate the discrete capacitor $C_o$, but not $C_b$.

Capacitor $C_b$ is eliminated as a standalone extra component because it is incorporated into the matching network. Thus, an efficient implementation of $C_o$ may be achieved in accordance with this embodiment of the present invention. Even with just one extra capacitor/open stub left, all the previous size/price concerns are still valid. Although a discrete capacitor external to the balun could be considered acceptable for some applications, the end circuits' sensitivity to value tolerances of this capacitor would render it challenging to maintain performance in mass production. Thus, the use of additional external capacitance becomes increasingly attractive as the desired operating frequency decreases.

Figure 28:
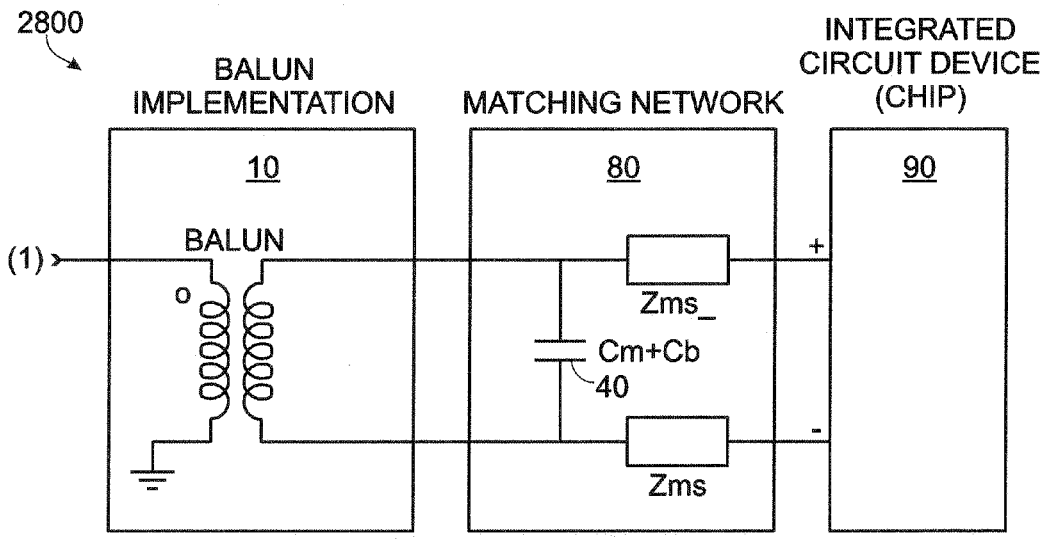
FIG. 28 is a schematic illustrating an exemplary means for combining the capacitances depicted in FIG. 27.

Referring to FIG. 28, a schematic view of a balun application 2800 in accordance with an alternate embodiment of the present invention is disclosed. The present inventor has noted that the capacitor $C_b$ may be viewed as part of the matching network. Since many RF IC devices 90 are inductive in nature, a matching network may be required to convert the balanced load impedance from a complex impedance to a real impedance, and this capacitance can be incorporated into the matching network as shown in FIG. 28. Thus, balun 10 is shown as including no discrete capacitors. Capacitor 40 (i.e., Cm+Cb) is provided as part of the matching network 80.

Figure 29:
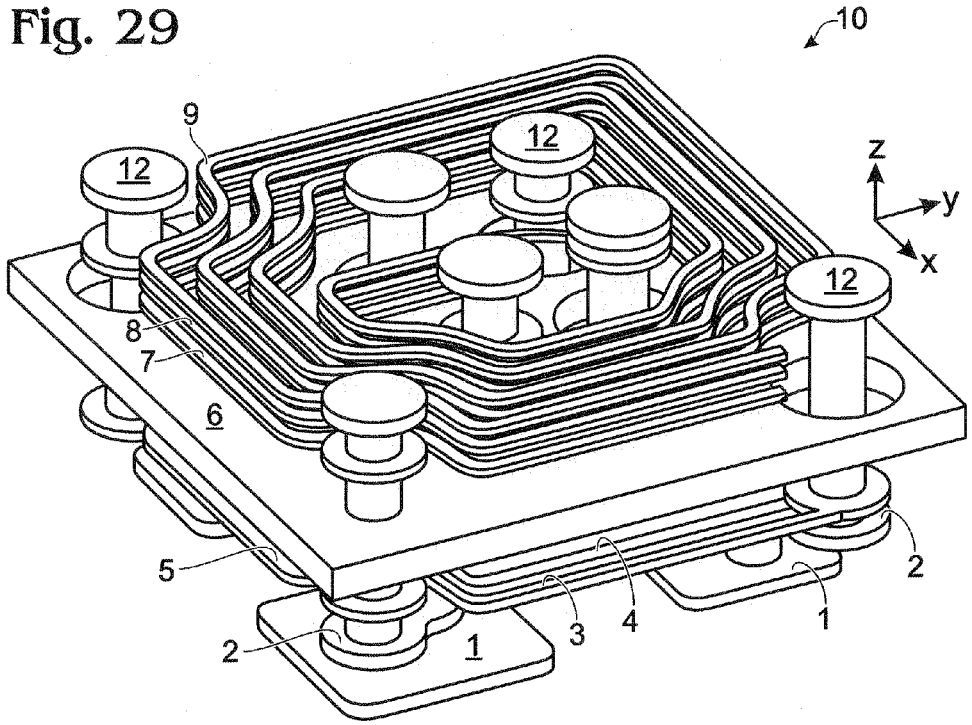
FIG. 29 is an isometric exploded detail view of the baluns depicted herein.
Figure 30:
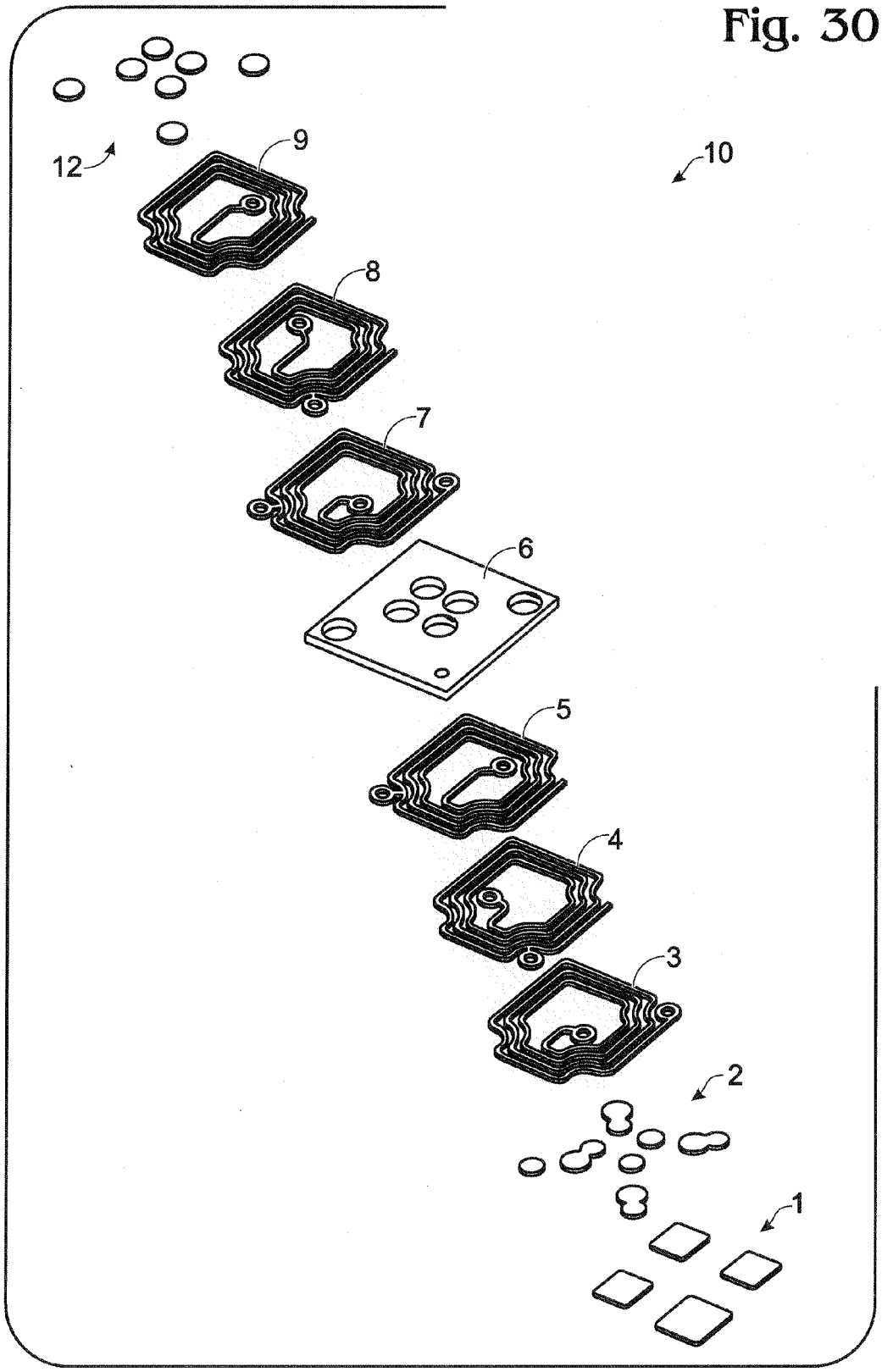
FIG. 30 is an exploded detail view of the implementation depicted in FIG. 29.

As embodied herein and depicted in FIG. 29, an isometric detail view of balun 10 is shown. FIG. 30 is an exploded detail view of FIG. 30. This embodiment of the present invention includes two sets of three coupled lines (9, 8, 7 and 5, 4, 3) on either side of an effectively solid ground plane 6. The transmission lines are interconnected by vias (2, 12) in accordance with the teachings of the present invention as described herein.

In this example, the transmission lines are implemented as meandered transmission lines. The various layers may be implemented using any suitable means. For example, the transmission lines may be realized by employing a softboard dielectric structure that features thin copper sheets disposed on either side thereof. The copper sheets are patterned to produce the meandered (or spiraled, etc.) pattern in accordance with the particular design. The present invention should not be construed as being limited to this particular implementation. As noted above, the present invention may be implemented using any suitable dielectric materials such as, e.g., ceramic layered dielectrics, polymer layered dielectrics or layered semiconductor based dielectrics.

This embodiment maintains coupling of three broadside transmission lines to provide a relatively compact x-y size by virtue of the reduced trace lengths. The third coupled line may also be employed to achieve a commensurate frequency lower than that dictated by the quarter wavelength of each individual coupler section. Further, in this embodiment, the implementation is asymmetric due to the lack of ground planes on the outer most sides of each set of coupled lines and it has an even and odd mode velocity difference of 1.6.

Figure 31:
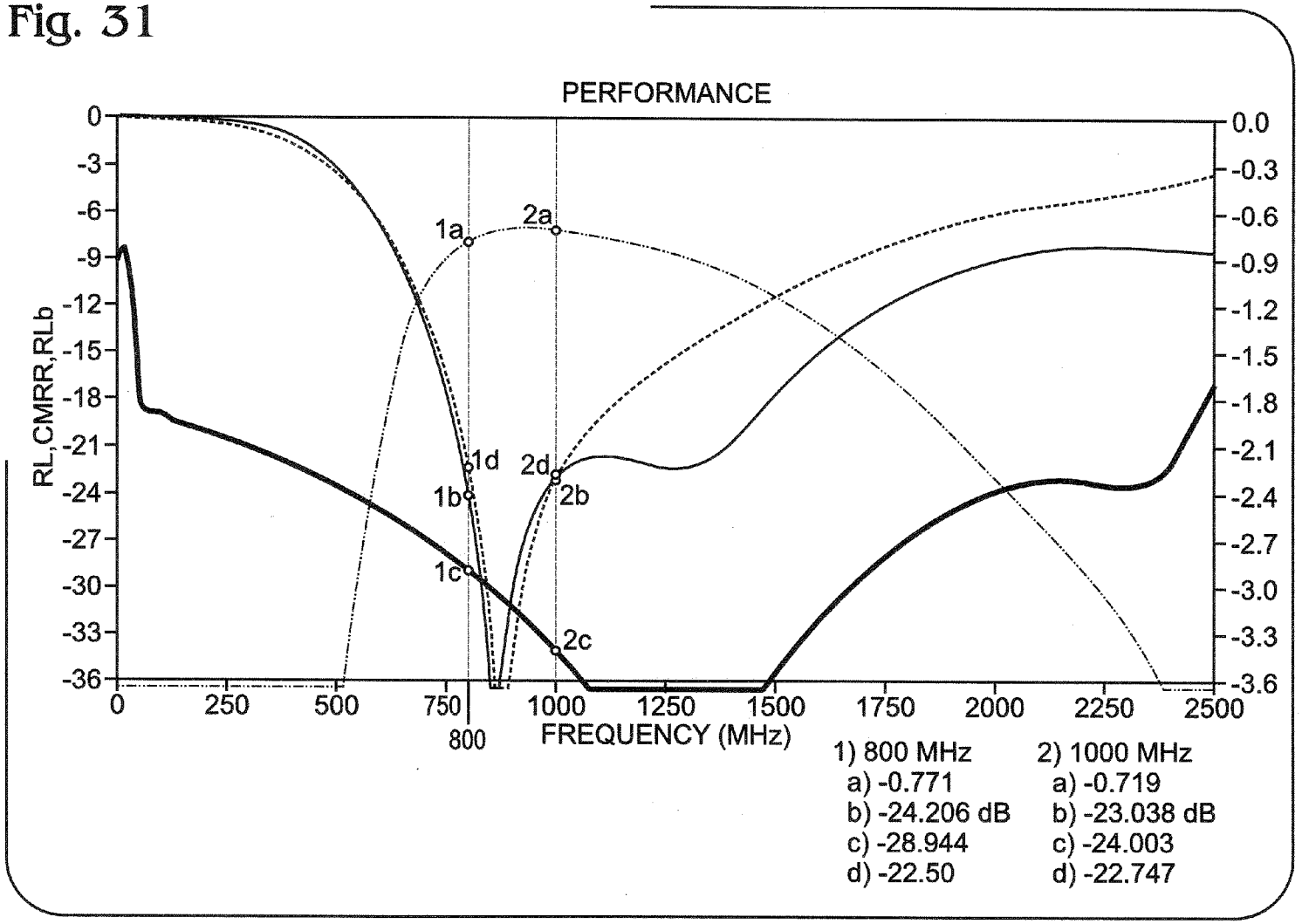
FIG. 31 is a chart illustrating the performance of the balun depicted in FIGS. 24 and 25.

Referring to FIG. 31, the nominal center frequency is 3900 MHz with a commensurate operating frequency of 900 MHz, i.e., more than 4 times. This exemplary embodiment is about 1 mm square and 0.6 mm high. In this embodiment, a 1.3 pF capacitor may be needed across the balanced port set as part of the matching network.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. A compact balun device comprising:

an unbalanced port and a set of balanced differential ports;

a first set of coupled transmission line structures coupled to the unbalanced port and one port of the set of balanced differential ports, the first set of coupled transmission line structures being characterized by at least one device parameter and a first length that is substantially equal to a quarter of a wavelength (λ), the wavelength (λ) corresponding to a first frequency;

a second set of coupled transmission line structures coupled to another port of the set of balanced differential ports, the second set of coupled transmission line structures being characterized by the at least one device parameter and a second length that is substantially equal to the quarter of a wavelength (λ), the wavelength (λ) corresponding to the first frequency; and a plurality of interconnections coupling the first set of coupled transmission line structures and the second set of coupled transmission line structures, the plurality of interconnections being configured such that the compact balun operates at a reduced operating frequency by selecting the at least one device parameter, the reduced operating frequency being within a balun operating bandwidth having a center frequency within a range of frequencies approximately between one-sixth of the first frequency and one-half the first frequency.

2. The device of claim 1, wherein the at least one device parameter is selected from a group of device parameters that includes capacitance value and position within the plurality of interconnections, system impedance, even-mode impedance, odd-mode impedance, a first number of transmission lines comprising the first pair of coupled transmission line structures, a second number of transmission lines comprising the second pair of coupled transmission line structures, transmission line length, or transmission line width.

3. The device of claim 1, wherein the first set of coupled transmission line structures includes a first discrete coupler and a second discrete coupler, and wherein the second set of coupled transmission line structures includes a third discrete coupler and a fourth discrete coupler, each discrete coupler including an input port, a direct port, a coupled port and an isolated port.

4. The device of claim 3, wherein the unbalanced port is coupled to the isolated port of the first discrete coupler, the input port of the first discrete coupler being coupled to ground, the direct port of the first discrete coupler being coupled to the input port of the third discrete coupler, the coupled port of the first discrete coupler being coupled to the input port of the fourth discrete coupler, the input port of the fourth discrete coupler forming a port of the set of balanced differential ports, the input port of the second discrete coupler being coupled to ground via a first capacitor, the isolated port of the second discrete coupler being coupled to ground, the direct port of the second discrete coupler being coupled to the isolated port of the third discrete coupler and forming another port of the set of balanced differential ports, the coupled port of the second discrete coupler being coupled to the isolated port of the fourth discrete coupler, the direct port of the third discrete coupler being coupled to ground, the coupled port of the third discrete coupler being coupled to the direct port of the fourth discrete coupler, the coupled port of the fourth discrete coupler being connected to ground.

5. The device of claim 4, further comprising a second capacitor disposed between the set of balanced differential ports.

6. The device of claim 1, wherein the first set of coupled transmission line structures includes a first set of four transmission line structures.

7. The device of claim 6, wherein two middle transmission line structures of the first set of four transmission line structures are implemented as a single transmission line.

8. The device of claim 6, wherein the second set of coupled transmission line structures includes a second set of three interdigital transmission lines.

9. The device of claim 8, wherein two middle transmission line structures of the second set of four transmission line structures are implemented as a single transmission line.

10. The device of claim 1, wherein the first set of coupled transmission line structures and the second the second set of coupled transmission line structures include broadside couplers or edge couplers.

11. The device of claim 1, wherein each of the first set of coupled transmission line structures and the second set of coupled transmission line structures include a Marchand coupler structure.

12. The device of claim 1, wherein the first set of coupled transmission line structures and the second set of coupled transmission line structures further comprise:

a Marchand balun structure including a first pair of coupled transmission lines connected to a second pair of coupled transmission lines, the unbalanced port, and the set of balanced differential ports, each transmission line being characterized by a length that is substantially equal to the quarter of a wavelength (λ); and a third transmission line coupled to the first pair of coupled transmission lines to thereby form a first set of coupled transmission lines and a fourth transmission line coupled to the second pair of coupled transmission lines to thereby form a second set of coupled transmission lines.

13. The device of claim 1, wherein the first set of coupled transmission line structures and the second set of coupled transmission line structures further comprise:

a first transmission line, a second transmission line and a third transmission line forming the first set of coupled transmission line structures, each of the first transmission line, second transmission line and third transmission line having a first side connection point and a second side connection point, the second transmission line being disposed between the first transmission line and the third transmission line; and a fourth transmission line, a fifth transmission line and a sixth transmission line forming the second set of coupled transmission line structures, each of the fourth transmission line, fifth transmission line and sixth transmission line having a first side connection point and a second side connection point, the fifth transmission line being disposed between the fourth transmission line and the sixth transmission line.

14. The device of claim 13, wherein the unbalanced port is connected to the first side connection point of the first transmission line, the second side connection point of the first transmission line being connected to the first side connection point of the third transmission line, the second side connection point of the third transmission line being connected to first side connection point of the sixth transmission line, the first side connection point of the second transmission line and the second side connection point of the fourth transmission line being coupled to ground, the second side connection point of the second transmission line and the first side connection point of the fourth transmission line forming the set of balanced differential ports.

15. The device of claim 14, wherein the second side connection point of the sixth transmission line is open circuited.

16. The device of claim 14, wherein the second side connection point of the sixth transmission line is coupled to ground.

17. The device of claim 16, wherein the first side connection point of the third transmission line is coupled to ground.

18. The device of claim 14, further comprising a capacitor disposed between the second side connection point of the sixth transmission line and ground.

19. The device of claim 14, further comprising a capacitor disposed between the balanced differential ports.

20. The device of claim 14, further comprising a first capacitor disposed between the second connection point of the sixth transmission line and ground, and a second capacitor disposed between the balanced differential ports.

21. The device of claim 13, wherein the unbalanced port is connected to the first side connection point of the first transmission line, the second side connection point of the first transmission line being connected to the first side connection point of the sixth transmission line, the second side connection point of the sixth transmission line being connected to the first side connection point of the third transmission line, the second side connection point of the third transmission line being connected to the first side connection point of the fourth transmission line, the first side connection point of the second transmission line and the second side connection point of the fifth transmission line being coupled to ground, the second side connection point of the second transmission line and the first side connection point of the fifth transmission line forming the set of balanced differential ports.

22. The device of claim 21, wherein the second side connection point of the third transmission line is open circuited.

23. The device of claim 21, wherein the second side connection point of the third transmission line is connected to ground.

24. The device of claim 21, further comprising a capacitor disposed between the second side connection point of the third transmission line and ground.

25. The device of claim 21, further comprising a capacitor disposed between the balanced differential ports.

26. The device of claim 21, further comprising a first capacitor disposed between the second side connection point of the third transmission line and ground, and a second capacitor disposed between the balanced differential ports.

27. The device of claim 13, wherein the unbalanced port is connected to the first side connection point of the second transmission line, the second side connection point of the second transmission line being connected to the first side connection point of the fourth transmission line, the first side connection point of the first transmission line and the first side connection point of the third transmission line being coupled to ground, the second side connection point of the first transmission line and the second side connection point of the third transmission line forming a first port of the balanced differential ports, the first side connection point of the fourth transmission line and the first side connection point of the sixth transmission line forming a second port of the balanced differential ports, the second side connection point of the fourth transmission line and the second side connection point of the sixth transmission line being coupled to ground, and further including at least one capacitor or at least one stub connected to ground.

28. The device of claim 27, wherein the first side connection point of the third transmission line is connected to a capacitor connected to ground.

29. The device of claim 27, further comprising a capacitor disposed between the balanced differential ports.

30. The device of claim 27, wherein the first side connection point of the sixth transmission line being connected to a capacitor connected to ground.

31. A compact balun device comprising:

a first pair of coupled transmission lines connected to a second pair of coupled transmission lines, an unbalanced port, and a set of balanced differential ports, each transmission line being characterized by a length that is substantially equal to a quarter of a wavelength (λ) the wavelength (λ) corresponding to a first frequency;

a third transmission line coupled to the first pair of coupled transmission lines to thereby form a first set of coupled transmission lines; and a fourth transmission line coupled to the second pair of coupled transmission lines to thereby form a second set of coupled transmission lines, the first set of coupled transmission lines being connected to the second set of coupled transmission lines such that the compact balun operates at a reduced operating frequency, the reduced operating frequency being effected by selecting at least one device parameter, the reduced operating frequency being within a predetermined range of frequencies having a center frequency between approximately one-sixth of the first frequency and one-half the first frequency.

32. The device of claim 31, wherein the at least one device parameter is selected from a group of device parameters that include capacitance value and position within the plurality of interconnections, system impedance, even-mode impedance, odd-mode impedance, a first number of transmission lines comprising the first pair of coupled transmission line structures, a second number of transmission lines comprising the second pair of coupled transmission line structures, transmission line length, or transmission line width.

33. A compact balun device comprising:

a Marchand balun structure including a first pair of coupled transmission lines connected to a second pair of coupled transmission lines, an unbalanced port, and a set of balanced differential ports, each transmission line being characterized by a length that is substantially equal to a quarter of a wavelength (λ), the wavelength (λ) corresponding to a first frequency; and a third transmission line coupled to the first pair of coupled transmission lines to thereby form a first set of coupled transmission lines and a fourth transmission line coupled to the second pair of coupled transmission lines to thereby form a second set of coupled transmission lines, the first set of coupled transmission lines being connected to the second set of coupled transmission lines such that the compact balun operates at a reduced operating frequency, the reduced operating frequency being effected by selecting at least one device parameter, the reduced operating frequency being within a predetermined range of frequencies having a center frequency between approximately one-sixth of the first frequency and one-half the first frequency.

34. The device of claim 33, wherein the at least one device parameter is selected from a group of device parameters that include capacitance value and position within the plurality of interconnections, system impedance, even-mode impedance, odd-mode impedance, a first number of transmission lines comprising the first pair of coupled transmission line structures, a second number of transmission lines comprising the second pair of coupled transmission line structures, transmission line length, or transmission line width.

* * * * *